US008509673B2

(12) United States Patent
Seto

(10) Patent No.: US 8,509,673 B2
(45) Date of Patent: Aug. 13, 2013

(54) SLIDE UNIT MOVING DEVICE WITH ENERGY-ASSISTED MOVEMENT, AND IMAGE FORMATION APPARATUS

(75) Inventor: Masaki Seto, Gotemba (JP)

(73) Assignee: Canon Kabushiki Kaisha, Tokyo (JP)

( * ) Notice: Subject to any disclaimer, the term of this patent is extended or adjusted under 35 U.S.C. 154(b) by 551 days.

(21) Appl. No.: 12/724,886

(22) Filed: Mar. 16, 2010

(65) Prior Publication Data

US 2010/0247136 A1 Sep. 30, 2010

(30) Foreign Application Priority Data

Mar. 24, 2009 (JP) ..... 2009-072610

(51) Int. Cl.
*G03G 15/00* (2006.01)
*B65H 5/22* (2006.01)

(52) U.S. Cl.
USPC ..... 399/377; 271/9.08

(58) Field of Classification Search
USPC ..... 399/377, 393, 388, 107, 16; 271/9.08, 271/147
See application file for complete search history.

(56) References Cited

U.S. PATENT DOCUMENTS

2007/0182088 A1* 8/2007 Tomura et al. ..... 271/157

FOREIGN PATENT DOCUMENTS

JP 11-310331 11/1999

OTHER PUBLICATIONS

Machine English Translation of JP11-310331 published on Nov. 9, 1999.*

Notification of Second Office Action (Translation), dated Jun. 27, 2012, issued by The State Intellectual Property Office of P.R. China, in Chinese Patent Application No. 201010140745.X.

* cited by examiner

*Primary Examiner* — Billy J Lactaoen
(74) *Attorney, Agent, or Firm* — Fitzpatrick, Cella, Harper & Scinto

(57) ABSTRACT

This invention improves operability at a final stage of moving a slide unit in one direction. A withdrawal mechanism 14 includes a charge spring 45 charged with energy to interlock withdrawal of a sheet cassette, a lock member 39 locking the charge spring in a state of being charged with the energy, a ratchet mechanism releasing interlocking of the charge spring with the sheet cassette with respect to movement of the sheet cassette in a push-in direction, and an unlock member 70*d* interlocking the sheet cassette with the charge spring and releasing locking of the charge spring at a final stage of moving the sheet cassette in the push-in direction. The sheet cassette is moved in the push-in direction by the energy charged in the charge spring at the final stage of moving the sheet cassette in the push-in direction.

10 Claims, 18 Drawing Sheets

SLIDE UNIT MOVING DEVICE WITH ENERGY-ASSISTED MOVEMENT, AND IMAGE FORMATION APPARATUS

BACKGROUND OF THE INVENTION

1. Field of the Invention

The present invention relates to a slide unit moving device provided between an apparatus main body of an image formation apparatus and a slide unit provided to be withdrawable from this apparatus main body, and moving the slide unit relatively to the apparatus main body, and an image formation apparatus including the slide unit moving device.

2. Description of the Related Art

Conventionally, a unit withdrawable from an apparatus main body is provided in such an image formation apparatus as a copying machine, a printer or a facsimile machine forming an image on a sheet. Examples of the unit of this type include a sheet cassette accommodating sheets therein, an image formation unit (such as a transfer unit or a fixing unit) forming an image on each sheet, and a duplex unit re-conveying a sheet having one surface on which an image is formed to the image formation unit. The image formation apparatus having the unit of this type provided to be withdrawable from the apparatus main body often includes a mechanism assisting in a withdrawal operation to improve operability for withdrawing the unit.

For example, there is known an image formation apparatus including a sheet cassette that is automatically pushed out upon user's depression of an operation button, as disclosed in Japanese Patent Application Laid-Open No. 11-310331. This image formation apparatus includes a push spring for a user to protrude the sheet cassette to outside of an apparatus main body. If the user pushes the sheet cassette into an accommodation position of an apparatus main body against an elastic force of the push spring when attaching the sheet cassette, a lock member locks the sheet cassette to the accommodation position. While the sheet cassette is being held at the accommodation position, a sheet is fed from the sheet cassette accommodating sheets therein.

If the user unlocks the lock member operating in cooperation with the operation button by depressing the operation button when withdrawing the sheet cassette, the sheet cassette is automatically pushed out by the push spring. This configuration facilitates withdrawing the sheet cassette.

However, the conventional image formation apparatus has the following problems. With the configuration in which the sheet cassette is automatically pushed out by the elastic force of the push spring, it is required to push the sheet cassette into the apparatus main body against the elastic force of the push spring when the sheet cassette is attached to the apparatus main body. Furthermore, the elastic force of the push spring is set high because of need to push out the sheet cassette from the accommodation position even in a state in which sheets are loaded in the sheet cassette up to a maximum loading capacity.

Due to this, the user is disadvantageously required to push the sheet cassette into the apparatus main body with a high force against the elastic force of the push spring when the sheet cassette is attached to the apparatus main body.

Furthermore, a recent image formation apparatus tends to increase a sheet loading capacity of a sheet cassette so as to improve operability while reducing frequency of feeding sheets to the sheet cassette. This disadvantageously requires a user to use higher force to push in the sheet cassette in which the sheets are loaded up to a maximum loading capacity, further deteriorating the operability.

While the operability of sheet cassette is described as above, a similar problem occurs to a transfer unit or a fixing unit configured to enable a transfer portion transferring a toner image onto a sheet or a fixing member fixing the toner image onto the sheet to be withdrawn from an apparatus main body. That is, as the image formation apparatus is increasingly adapted to color image formation, an image formation unit uses a plurality of photosensitive drums and a fixing member having a large heat capacity. This makes the image formation unit large in size and heavy. Due to this, the same problem of deterioration of operability as that with the sheet cassette occurs to configurations of pushing out these units using push springs.

The present invention provides a slide unit moving device that makes it unnecessary for a user to push a unit automatically pushed out by a push spring into an apparatus main body of an image formation apparatus with a high force, and an image formation apparatus including the slide unit moving device.

SUMMARY OF THE INVENTION

According to the invention, a slide unit moving device provided between an apparatus main body of an image formation apparatus and a slide unit provided on the apparatus main body to be withdrawable from the apparatus main body, and moving the slide unit with respect to the apparatus main body, includes: a charge elastic member which is charged with energy to interlock with the slide unit moving in one direction; a lock unit which locks the charge elastic member into a state of being charged with the energy; an interlocking release unit which releases interlocking of the charge elastic member with the slide unit with respect to the moving of the slide unit in other direction; and an unlock unit which interlocks the slide unit with the charge elastic member and releasing locking of the charge elastic member at a final stage of moving the slide unit in the other direction, wherein the slide unit is moved in the other direction by the energy charged in the charge elastic member at the final stage of moving the slide unit in the other direction.

A slide unit moving device according to the present invention charges a charge elastic member with energy when a slide unit moves in one direction, and moves the slide unit in other direction by the energy charged in the charge elastic member at a final stage of moving the slide unit in other direction.

In this way, in the slide unit moving device according to the present invention, the slide unit is moved in the other direction by the energy charged in the charge elastic member at the final stage of moving the slide unit in the other direction. Therefore, operability at the final stage can be improved. Besides, the slide unit can be moved until the last and set at a last position.

Further features of the present invention will become apparent from the following description of exemplary embodiments (with reference to the attached drawings).

BRIEF DESCRIPTION OF THE DRAWINGS

FIGS. 3A and 3B are cross-sectional views of a mechanism of moving up an intermediate plate of a sheet cassette in a sheet conveyance direction, wherein FIG. 3A is the cross-sectional view when the intermediate plate is moved up and FIG. 3B is the cross-sectional view when the intermediate plate is moved down.

FIGS. 12A and 12B are plan views of the withdrawal mechanism for describing a ratchet mechanism provided between a charge input gear and a ratchet gear, wherein FIG. 12A is the plan view for describing the ratchet mechanism that does not operate, and FIG. 12B is the plan view for describing the ratchet mechanism that separates the charge input gear from the ratchet gear.

FIG. 17 is a diagram illustrating positional relationship between a sheet cassette control force and the sheet cassette, wherein

DESCRIPTION OF THE EMBODIMENTS

Figure 1:
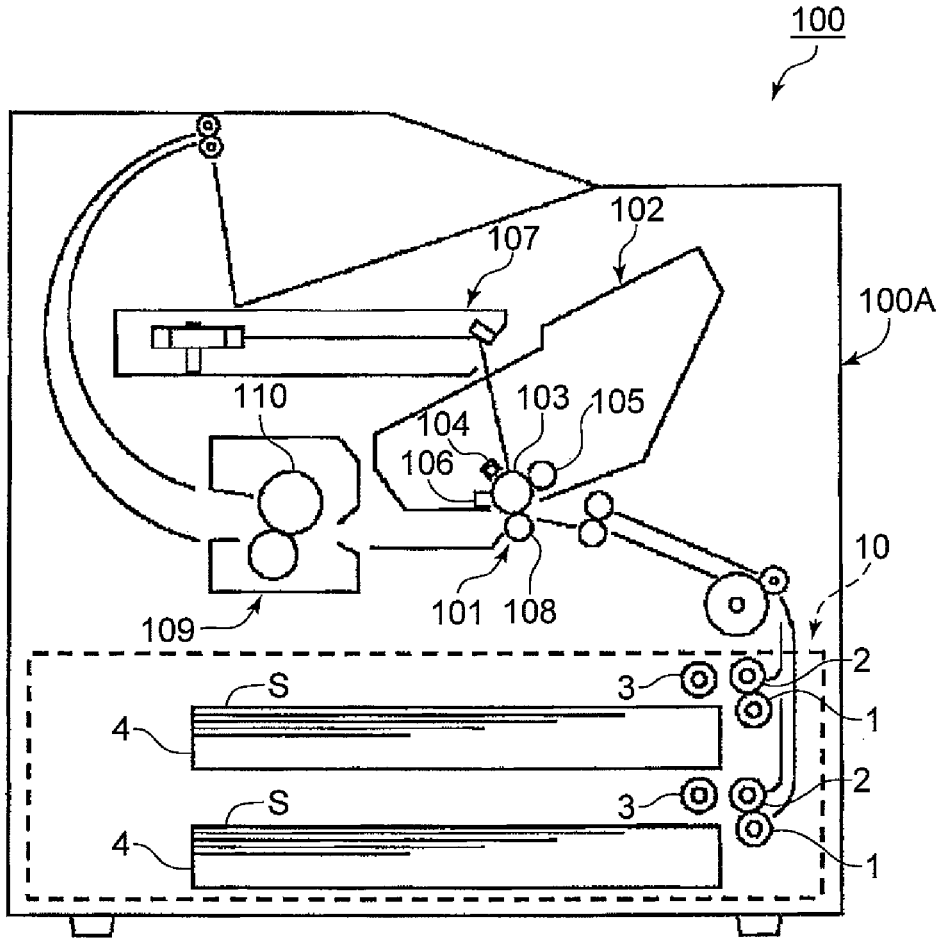
FIG. 1 is a cross-sectional view of an image formation apparatus according to an embodiment of the present invention along a sheet conveyance direction.

A sheet cassette device serving as a slide unit moving device according to an embodiment of the present invention including a drag-in mechanism, and an image formation apparatus including this sheet cassette device in an apparatus main body and forming an image on a sheet fed by the sheet cassette device will be described.

(Image Formation Apparatus)

The image formation apparatus including the sheet cassette device according to the embodiment of the present invention will be schematically described with reference to FIG. 1. While the image formation apparatus according to the embodiment of the present invention is a laser beam printer, the image formation apparatus is not limited to the laser beam printer. The image formation apparatus may be a copying machine, a facsimile machine or the like.

A sheet cassette 4 of a sheet cassette device 10 is a front loading type sheet cassette detachable from a front surface of an apparatus main body 100A of a printer 100 that is an example of the image formation apparatus. A sheet S loaded in the sheet cassette 4 serving as a slide unit is fed in a direction orthogonal to a withdrawal and push-into direction of the sheet cassette 4.

The sheet S fed from the sheet cassette 4 is discharged to outside via an image formation unit 101 and a fixing member 109. The image formation unit 101 includes a process cartridge 102 detachable from the printer 100. This process cartridge 102 includes a photosensitive drum 103, a charging member 104 charging a surface of the photosensitive drum 103, a developing member 105 forming a toner image on the photosensitive drum 103, a cleaner 106 removing toner remaining on the surface of the photosensitive drum 103, and the like. The photosensitive drum 103, which is an electrophotographic photosensitive drum serving as an image bearing member, exposes an image to an image light irradiated from a scanner unit 107 according to an image signal, thereby forming a latent image. The developing member 105 develops the latent image with toner to visualize the latent image as a toner image.

The image formation unit 101 also includes a transfer roller 108 for transferring the toner image formed on the photosensitive drum 103 onto a sheet. A voltage opposite in polarity to the toner image is applied to this transfer roller 108. The transfer roller 108 presses the sheet S fed from the sheet cassette 4 against the photosensitive drum 103 so as to transfer the toner image on the photosensitive drum 103 onto the sheet S.

The sheet S onto which the transfer roller 108 transfers the toner image is fed to the fixing member 109. A fixing roller 110 is arranged in this fixing member 109, and the fixing member 109 applies heat and pressure to the sheet S to fix the toner image on the sheet S.

In this way, the process cartridge 102 and the transfer roller 108 transfer the toner image onto the sheet S fed from the sheet cassette 4, the fixing member 109 fixes the toner image on the sheet S, and the sheet S is discharged.

(Sheet Cassette Device 10)

Figure 2:
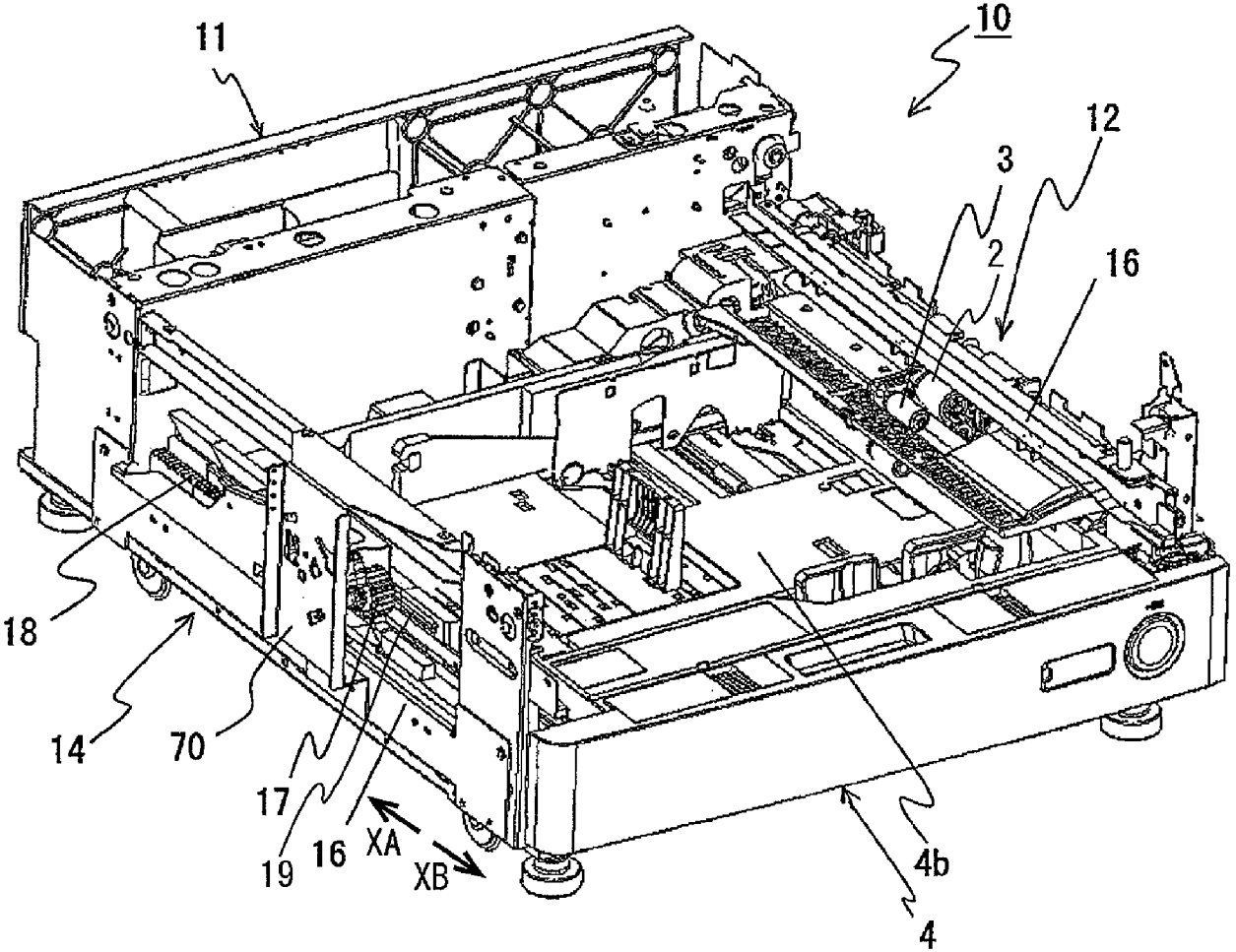
FIG. 2 is an external perspective view of a sheet cassette device including a withdrawal mechanism of a slide unit moving device according to the embodiment of the present invention.

FIG. 2 is a schematic perspective view of the sheet cassette device 10 according to this embodiment.

The sheet cassette device 10 mainly includes a sheet cassette frame 11, a sheet feeder 12, a sheet cassette 4, and a withdrawal mechanism 14. The sheet cassette device 10 illustrated in FIG. 2 includes a plurality of stages as illustrated in FIG. 1 or includes only one stage.

An arrow XB is a direction in which a user withdraws the sheet cassette 4 or in which a push spring 48 serving as a moving elastic member pushes out the sheet cassette 4. An arrow XA is a direction in which the user pushes the sheet cassette 4 or the sheet cassette device 10 pulls in the sheet cassette 4.

(Sheet Cassette 4 of Sheet Cassette Device)

Figure 4:
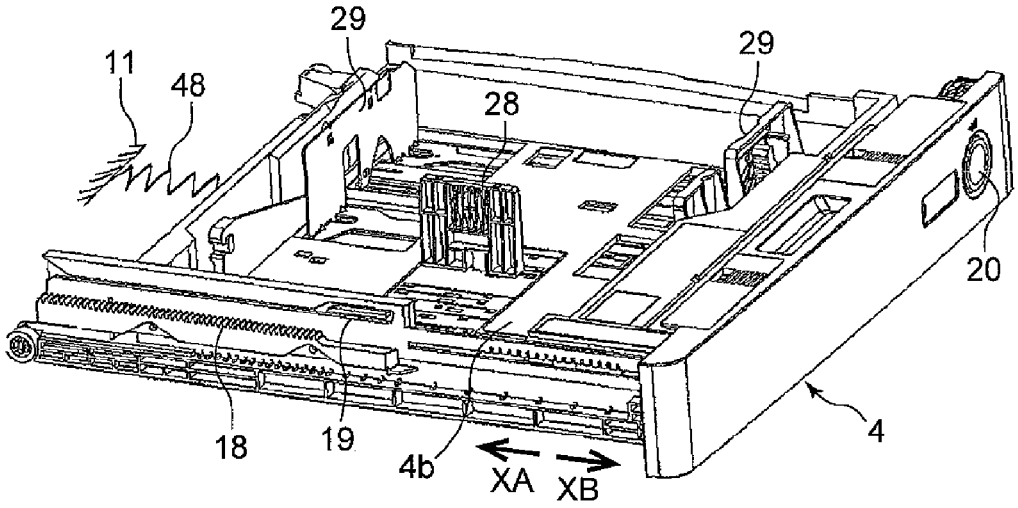
FIG. 4 is a schematically external perspective view of the sheet cassette illustrated in FIG. 2.

FIG. 4 is a schematic diagram of the sheet cassette 4.

The sheet cassette 4 moves on rails 16 attached bilaterally symmetrically to the sheet cassette frame 11 that is a part of the apparatus main body 100A by being attached integrally to the apparatus main body 100A while being supported on a slide surface that is not illustrated.

A sheet restriction plate 28 restricting a rear end of a group of sheets S in a conveyance direction, and a pair of side restriction plates 29 restricting side ends of the group of sheets S in the conveyance direction are provided in a portion of the sheet cassette 4 in which portion the sheets S are accommodated. The intermediate plate 4*b* is provided on a bottom of the portion.

A rack 18 (FIG. 4) is provided on a side portion of the sheet cassette 4 opposing the withdrawal mechanism 14. A charge input gear 17 and a charge output gear 38 (FIG. 8) of the withdrawal mechanism 14 are selectively engageable (interlockable) with the rack 18 in a direction along input or output of the sheet cassette 4. The charge input gear 17 serving as a charge input rotating member and the charge output gear 38 serving as a charge output rotating member are selectively engaged with the rack 18 by oscillation of an oscillation frame 62 to be described later.

An oscillation switching groove 19 with which a shaft end 31*a* (FIGS. 11, 12, and 16) of an input shaft 31 of the withdrawal mechanism 14 is engaged and which performs an oscillation (rotation) switching operation for the oscillation unit 30 is provided on the same side portion of the sheet cassette 4. Further, a positioning pin 27 fitted into a positioning hole (not illustrated) for engaging pins arranged in a rear portion and a right front portion of the sheet cassette frame 11 is provided on a right front side of the sheet cassette 4 backward.

(Accommodation Position Holding Mechanism 80 of Sheet Cassette Device)

The push spring 48 serving as the moving elastic member pushing out the sheet cassette 4 in the arrow XB direction is provided between a rear portion (left end in FIG. 4) of the sheet cassette 4 and the sheet cassette frame 11. Due to this, an accommodation position holding mechanism 80 is provided right front between the sheet cassette 4 (FIG. 5) and the sheet cassette frame 11 so as to prevent the sheet cassette 4 from being pushed by the push spring 48 and protruding from the sheet cassette frame 11 unnecessarily.

Figure 5:
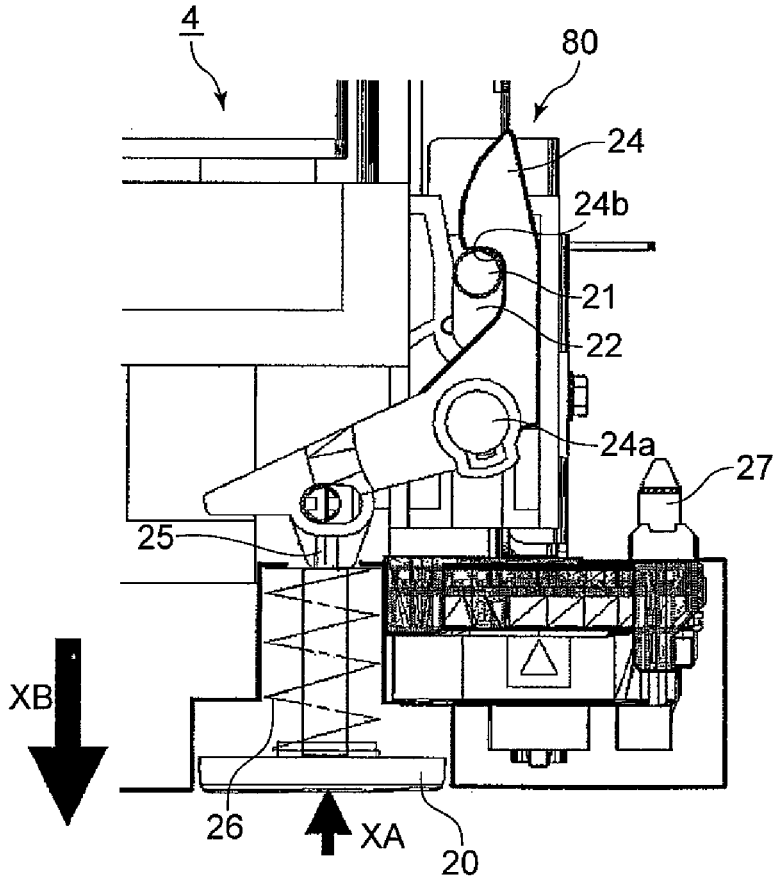
FIG. 5 is a plan view of a latch mechanism of locking the sheet cassette to a sheet cassette frame.

The accommodation position holding mechanism 80 illustrated in FIG. 5 includes a latch shaft 21 attached to the sheet cassette frame 11, a slide groove 22 engaged with the latch shaft 21 and provided on a casing of the sheet cassette 4, a latch member 24 rotatably provided in a boss 24*a* provided in the sheet cassette 4 and latched to the latch shaft 21, a latch link member 25 interlocking with the latch member 24 and oscillating, a push spring 26 pulling the latch link member 25 forward of the sheet cassette 4, and a button 20 rotating the latch member 24. An attachment position of the latch shaft 21 at which the latch shaft 21 is attached to the sheet cassette frame 11 is adjustable in withdrawal or push-in directions of the sheet cassette 4 so as to reduce positional error in a feed direction of the sheets S loaded in the sheet cassette 4.

If the sheet cassette 4 is to be accommodated in the sheet cassette frame 11, then the latch member 24 is pushed aside by the latch shaft 21 to rotate about the boss 24*a*, and an engagement portion 24*b* of the latch member 24 is engaged with the latch shaft 21. If the sheet cassette 4 is withdrawn in a direction of the arrow XB illustrated in FIG. 5, the user depresses the button 20 against the push spring 26 in an arrow XA direction. Accordingly, the latch link member 25 is pushed and the latch member 24 linking with the latch link member 25 rotates in a latch release direction. As a result, the sheet cassette 4 held at the accommodation position is pushed out in a front direction (the direction of the arrow XB) of the sheet cassette frame 11 by the push spring 48 (FIG. 4).

(Sheet Feeder 12 of Sheet Cassette Device)

Figure 3A:
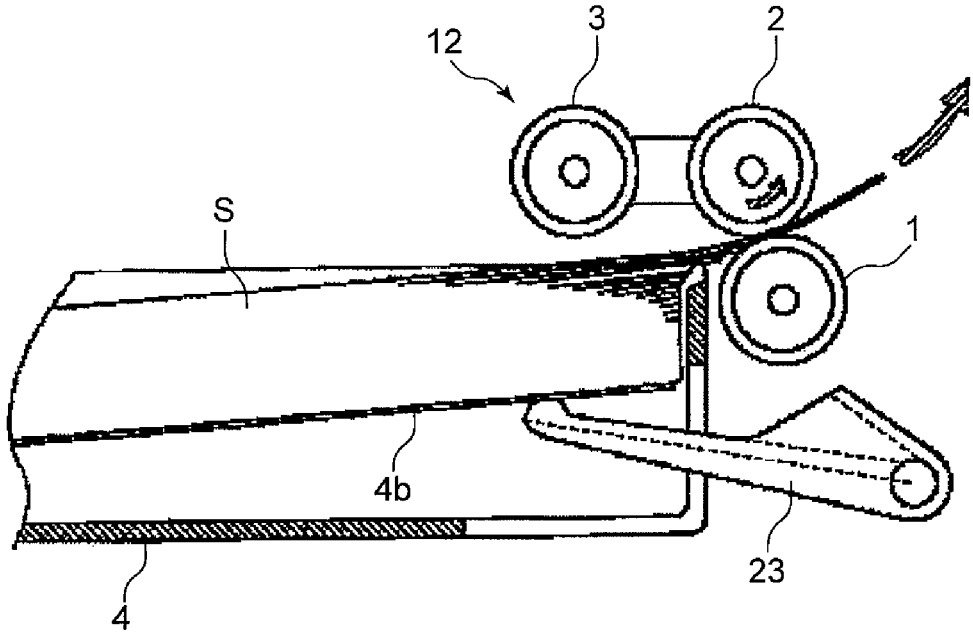
Figure 3B:
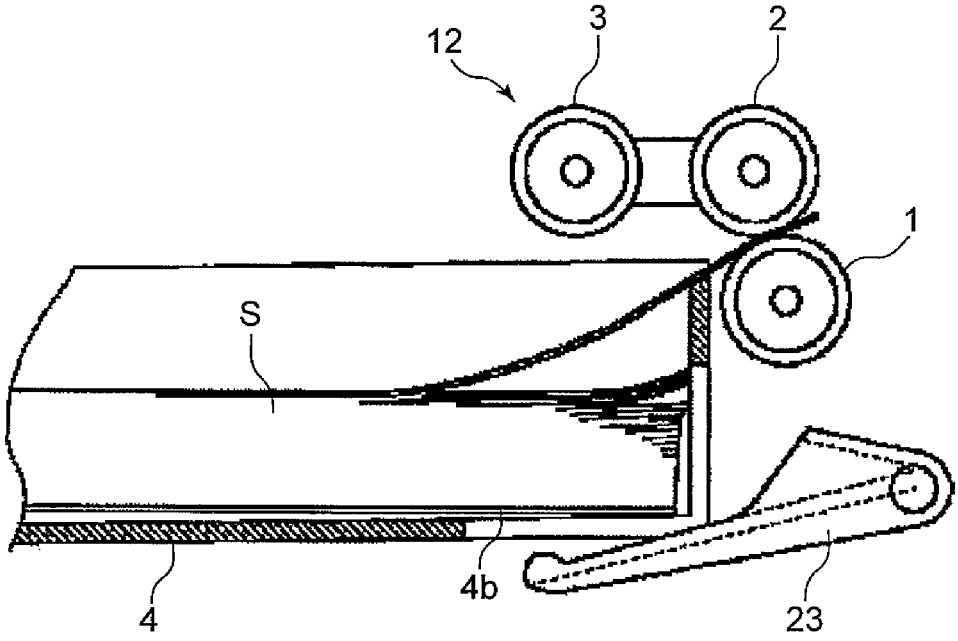

The sheet feeder 12 will be described with reference to FIGS. 3A and 3B.

The sheet feeder 12 includes a lift-up member 23 that pushes up the intermediate plate 4*b* which is provided in the sheet cassette 4 and on which the sheets S are loaded, and keeping an uppermost sheet S at a constant height position. When the sheet cassette 4 is accommodated in the sheet cassette frame 11, an accommodation detection sensor (not illustrated) detects whether the sheet cassette 4 is accommodated in the sheet cassette frame 11. In addition, the intermediate plate 4*b* engaged with the lift-up member 23 makes preparation for a sheet feed operation for lifting up the sheet S until the sheet S abuts on a pickup roller 3.

Furthermore, the sheet feeder 12 includes the pickup roller 3 feeding the sheet S pushed up by the lift-up member 23 from the sheet cassette 4.

The sheet feeder 12 also includes a retard roller 1 provided rotatably in a direction of returning the sheets with respect to a sheet feed direction for preventing a plurality of sheets from being fed, and a feed roller 2 for feeding the sheet S in the feed direction. The retard roller 1 pressure-contacts with the feed roller 2 at predetermined separation pressure. A torque limiter is provided in a drive transmission mechanism of the retard roller 1.

If a plurality of sheets enters (a plurality of sheets is fed) between the retard roller 1 and the feed roller 2, then the retard roller 1 rotates inversely and feeds the sheets other than the uppermost sheet fed by the feed roller 2 inversely. If one sheet S enters between the retard roller 1 and the feed roller 2 or does not enter therebetween, then the torque limiter is turned off and the retard roller 1 rotates to follow up the sheets S or the feed roller 2.

(Withdrawal Mechanism 14 of Sheet Cassette Device)

Figure 6:
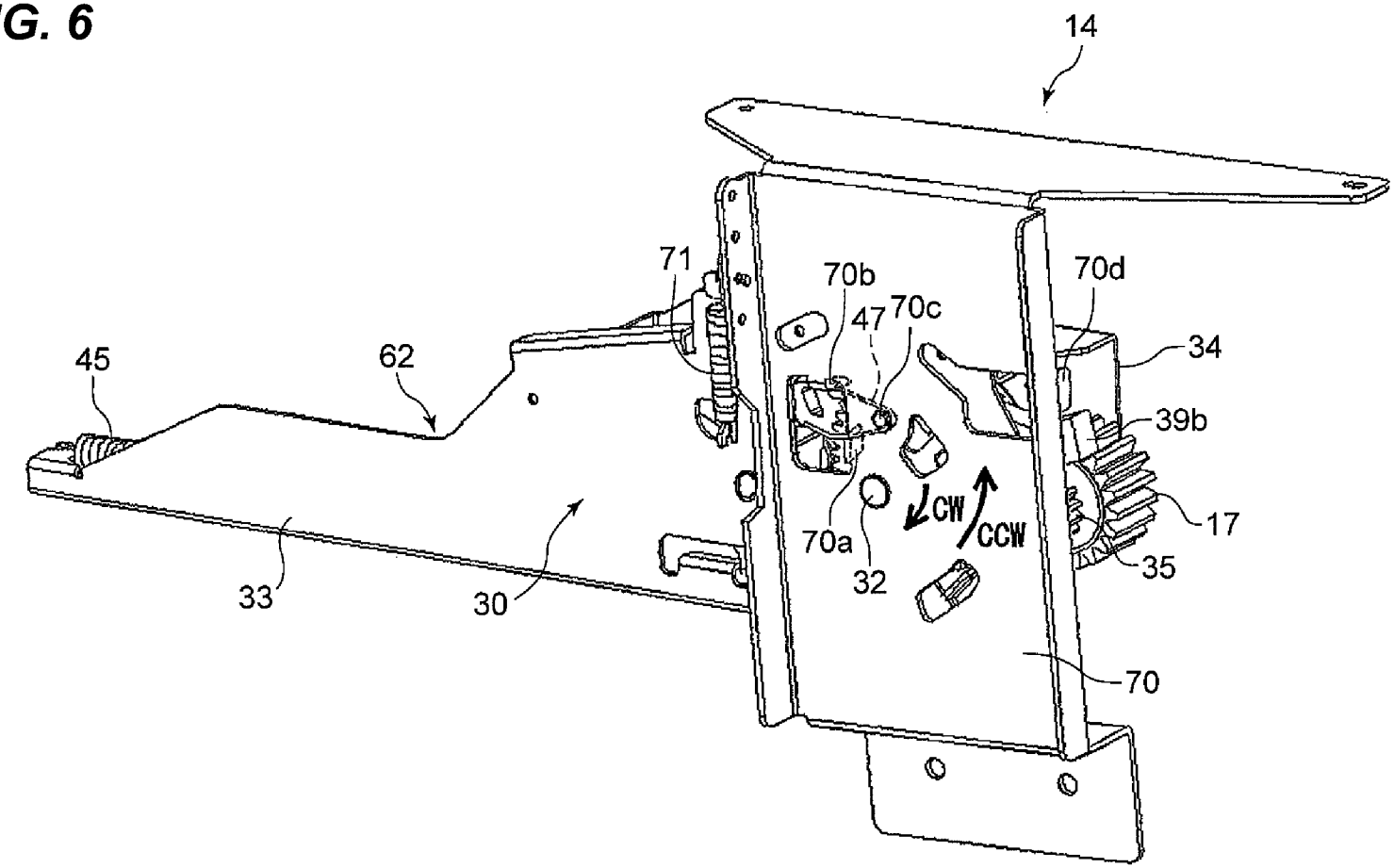
FIG. 6 is a schematically external perspective view of an oscillation unit and a fixed frame of the sheet cassette frame on which the oscillation unit is rotatably provided.

The withdrawal mechanism 14 serving as the slide unit moving device will be described with reference to FIGS. 2 and 6 to 14. The withdrawal mechanism 14 is provided between a fixed frame 70 and the sheet cassette 4 on a left side portion of the sheet cassette frame 11 illustrated in FIG. 2. In FIG. 6, the withdrawal mechanism 14 includes the oscillation unit 30 oscillating (rotating) in a direction of an arrow CW and a direction of an arrow CCW about an oscillation central shaft 32 on the fixed frame 70. An oscillation spring 71 provided to spread between a side plate 33 (or 34) of the oscillation unit 30 and the fixed frame 70 and serving as an oscillation elastic member applies a rotational force in the direction of the arrow CW in FIGS. 6 to 8 to the oscillation unit 30. As illustrated in FIG. 8, the oscillation unit 30 to which the rotational force in the direction of the arrow CW is applied normally stops rotating in the direction of the arrow CW by engagement of the charge input gear 17 with the rack 18.

The oscillation unit 30 includes two side plates 33 and 34 that are provided to be rotatable about the oscillation central shaft 32 on the fixed frame 70 in the direction of the arrow CW and a direction of an arrow CCW. The two side plates 33 and 34 fixedly support an input shaft 31 that is a gear shaft of a reduction gear train 76 and a spindle 41 of the lock member 39, and rotatably supports an output shaft 42 of the charge output gear 38.

The two side plates 33 and 34, the input shaft 31, the spindle 41 and the like form an oscillation frame 62. The oscillation frame 62 is provided to oscillate by the oscillation central shaft 32 with respect to the fixed frame 70 that is a part of the apparatus main body.

The input shaft 31 rotatably supports the charge input gear 17 engaged with the rack 18 of the sheet cassette 4 when the oscillation unit 30 rotates in the direction of the arrow CW. A ratchet gear 35 is also provided rotatably on the input shaft 31.

Figure 11:
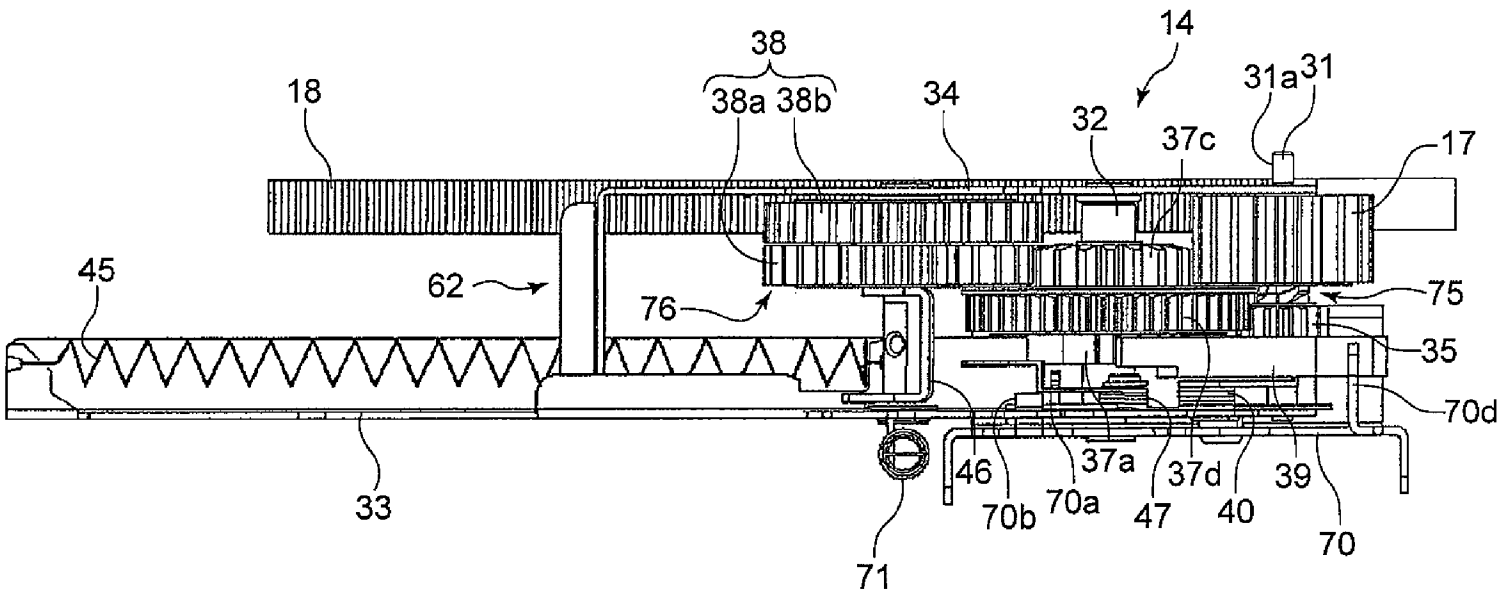
FIG. 11 is a plan view of the withdrawal mechanism.
Figure 12A:
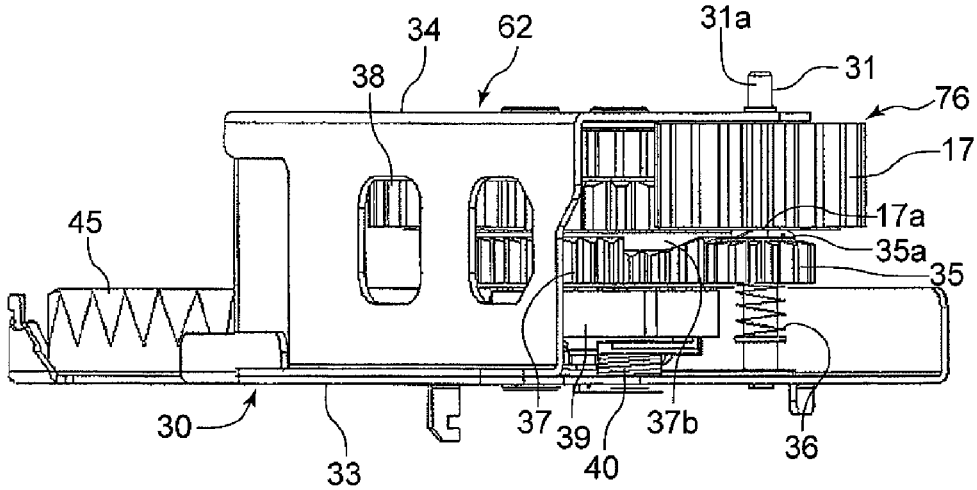
Figure 12B:
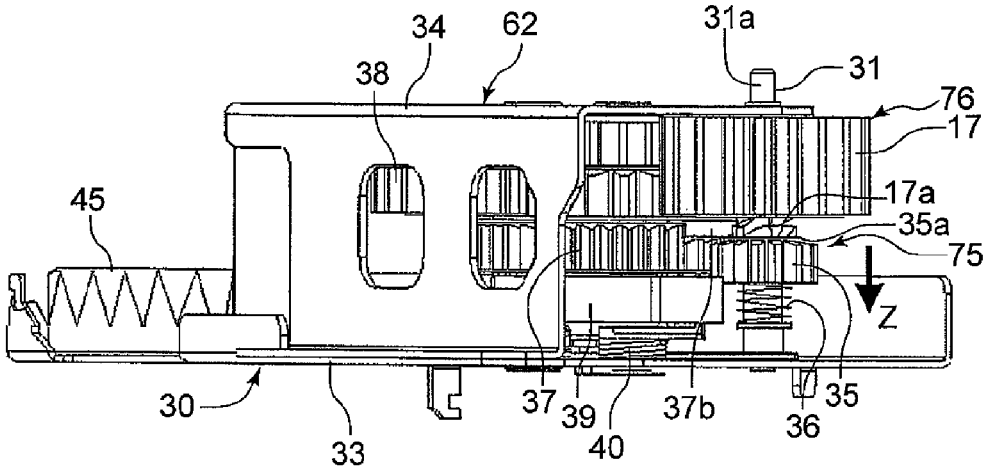
Figure 13:
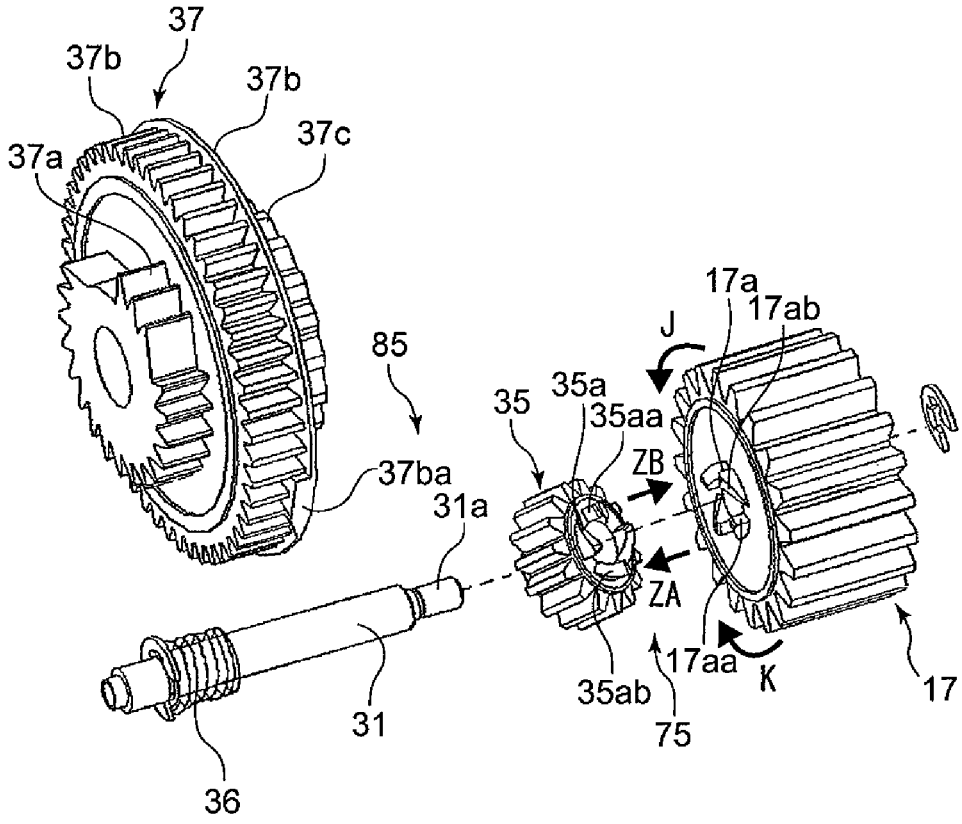
FIG. 13 is an exploded perspective view of the ratchet mechanism and a limit mechanism.

As illustrated in FIGS. 11 to 13, a ratchet mechanism 75 is provided on the charge input gear 17 and the ratchet gear 35.

As illustrated in FIG. 13, the ratchet mechanism 75 includes a ratchet projection 17*a*, a rib 35*a*, and a compression spring 36.

The ratchet projection 17*a* is formed into a right triangle and provided to protrude on a side surface of the charge input gear 17 toward the ratchet gear 35. The rib 35*a* is provided on a side surface of the ratchet gear 35 to protrude toward the charge input gear 17. The compression spring 36 is a compression coil spring provided on the input shaft 31 and pressing the ratchet gear 35 against the charge input gear 17.

Normally, the ratchet gear 35 is urged at low weight by the compression spring 36 on the input shaft 31 in a direction of an arrow ZB and pressed against the charge input gear 17, whereby the ratchet projection 17*a* is engaged with the rib 35*a*. In a state in which the ratchet projection 17*a* is engaged with the rib 35*a*, when the charge input gear 17 rotates in a direction of an arrow J, a rotational force is transmitted to the ratchet gear 35 by abutment of an upright surface 17*aa* of the ratchet projection 17*a* on an upright surface 35*aa* of the rib 35*a*. However, if the charge input gear 17 rotates in a direction of an arrow K, then an inclined surface 17*ab* of the ratchet projection 17*a* abuts on an inclined surface 35*ab* of the rib 35*a*, the ratchet gear 35 is pressed in a direction of an arrow ZA against the compression spring 36, and the ratchet gear 35 separates from the charge input gear 17. As a result, a rotational force of the charge input gear 17 is not transmitted to the ratchet gear 35.

The ratchet gear 35 often moves in the direction of the arrow ZA by rotation of a ratchet stage gear 37. This operation will be described later.

The charge input gear 17 rotates in a direction of an arrow J when the sheet cassette 4 is moved in a withdrawal direction (charge direction or the direction of the arrow XB in FIGS. 8 and 9) in a state in which the charge input gear 17 is engaged with the rack 18.

In this way, the ratchet mechanism 75 is interlocking release unit for releasing interlocking of the charge spring 45 with the sheet cassette 4 with respect to movement in the withdrawal direction (direction of the arrow XB, another direction) of the sheet cassette 4. That is, the ratchet mechanism 75 is incorporated into the reduction gear raw 76 to allow opposite rotation of the charge input gear 17 when the sheet cassette 4 moves in the other direction and the charge input gear 17 interlocking with the sheet cassette 4 rotates inversely.

The input shaft 31 has a shaft end 31*a* (FIGS. 11 and 12) penetrating the side plate 34 on the sheet cassette side and protruding toward the sheet cassette 4. The shaft end 31*a* is engaged with the oscillation switching groove 19 (FIGS. 4 and 6) of the sheet cassette 4. As illustrated in FIG. 13, the ratchet stage gear 37 has ratchets projection 37*a*, a large-diameter gear 37*d*, and a small-diameter gear 37*c* formed integrally. As illustrated in FIG. 11, the ratchet stage gear 37 is provided rotatably on the oscillation central shaft 32. The charge output gear 38 is rotatably provided on the output shaft 42. The large-diameter gear 37*d* is engaged with the ratchet gear 35. The small-diameter gear 37*c* is engaged with the charge output gear 38. Due to this, engagement of the small-diameter ratchet gear 35 with the large-diameter ratchet gear 37*d* and that of the small-diameter gear 37*c* with the large-diameter charge output gear 38 reduces velocity of rotation of the charge input gear 17, and the velocity-reduced rotation of the charge input gear 17 is transmitted to the charge output gear 38. Accordingly, the charge input gear 17, the ratchet gear 35, the ratchet stage gear 37, and the charge output gear 38 form the reduction gear train 76 provided on the side plates 33 and 34 and serving as a rotating member train.

Figure 16:
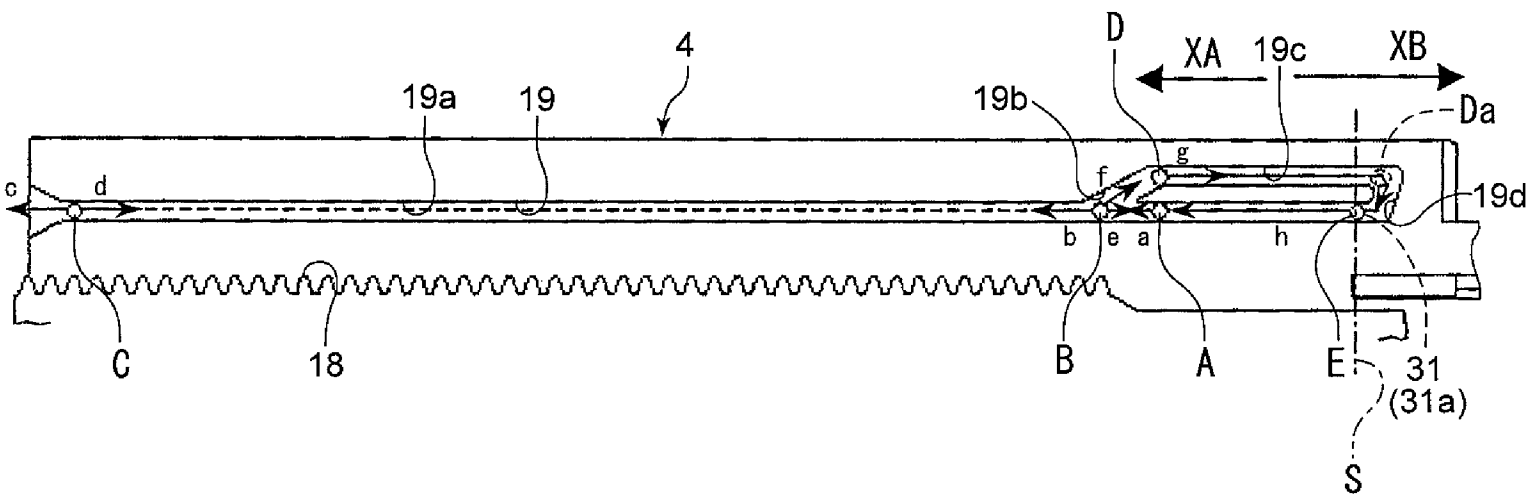
FIG. 16 is a diagram illustrating positional relationship between an input shaft and an operation switching groove when the sheet cassette is withdrawn, pushed into, and dragged into.

The oscillation switching groove 19 illustrated in FIG. 16 is formed on the side surface of the sheet cassette 4 which surface faces the reduction gear train 76. The oscillation switching groove 19 includes a linear groove 19*a*, a branch groove 19*b*, an oscillation holding groove 19*c*, and a return groove 19*d*. The linear groove 19*a* is formed linearly along a moving direction of the sheet cassette 4. The branch groove 19*b* serving as an inclined portion is formed to branch upward from the linear groove 19*a* near a front side of the sheet cassette 4. The oscillation holding groove 19*c* is formed in parallel to the linear groove 18*a* forward to be continuous to the branch groove 19*b*. The return groove 19*d* connects a front-side (withdrawal-side) ends of the linear groove 19*a* and the oscillation holding groove 19*c* to each other.

Figure 7:
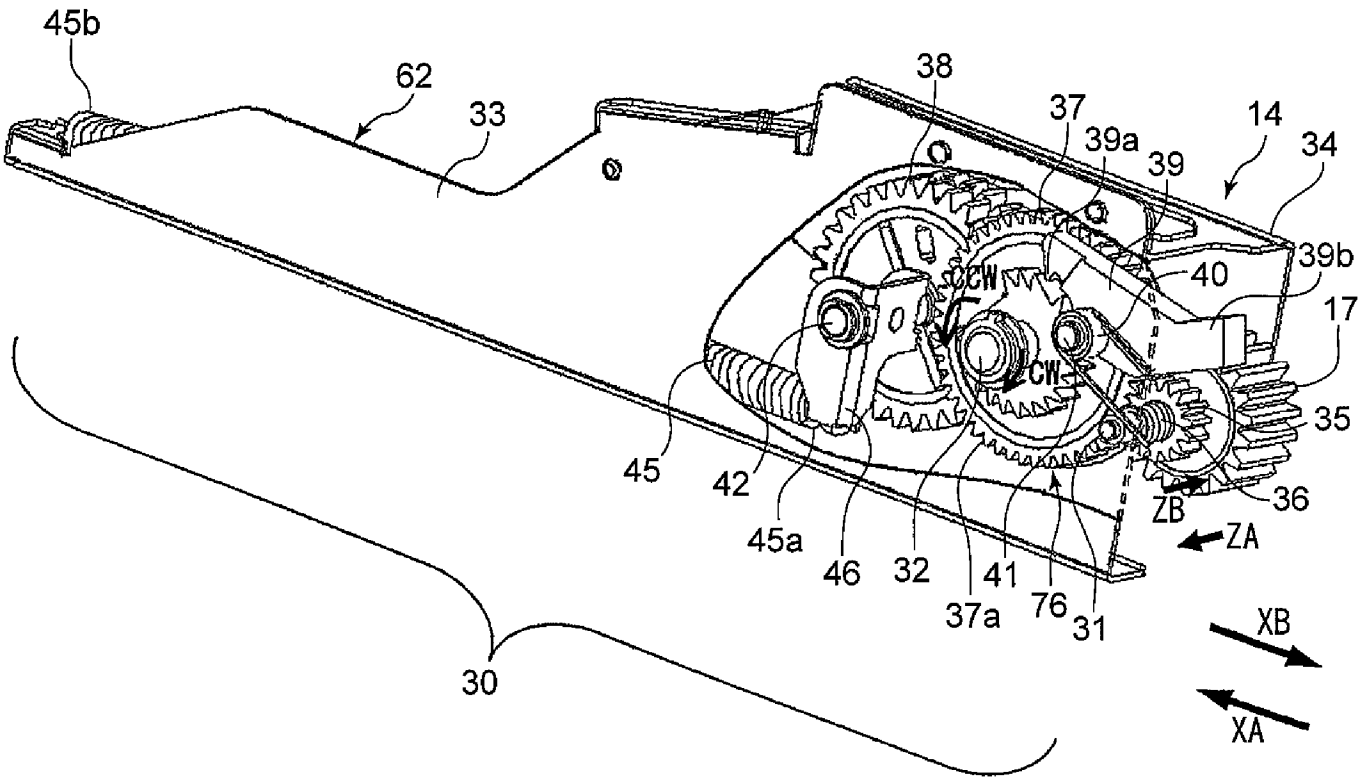
FIG. 7 is a cutaway diagram illustrating a cut-away part of a side plate of the oscillation unit so that a reduction gear train is visible.
Figure 8:
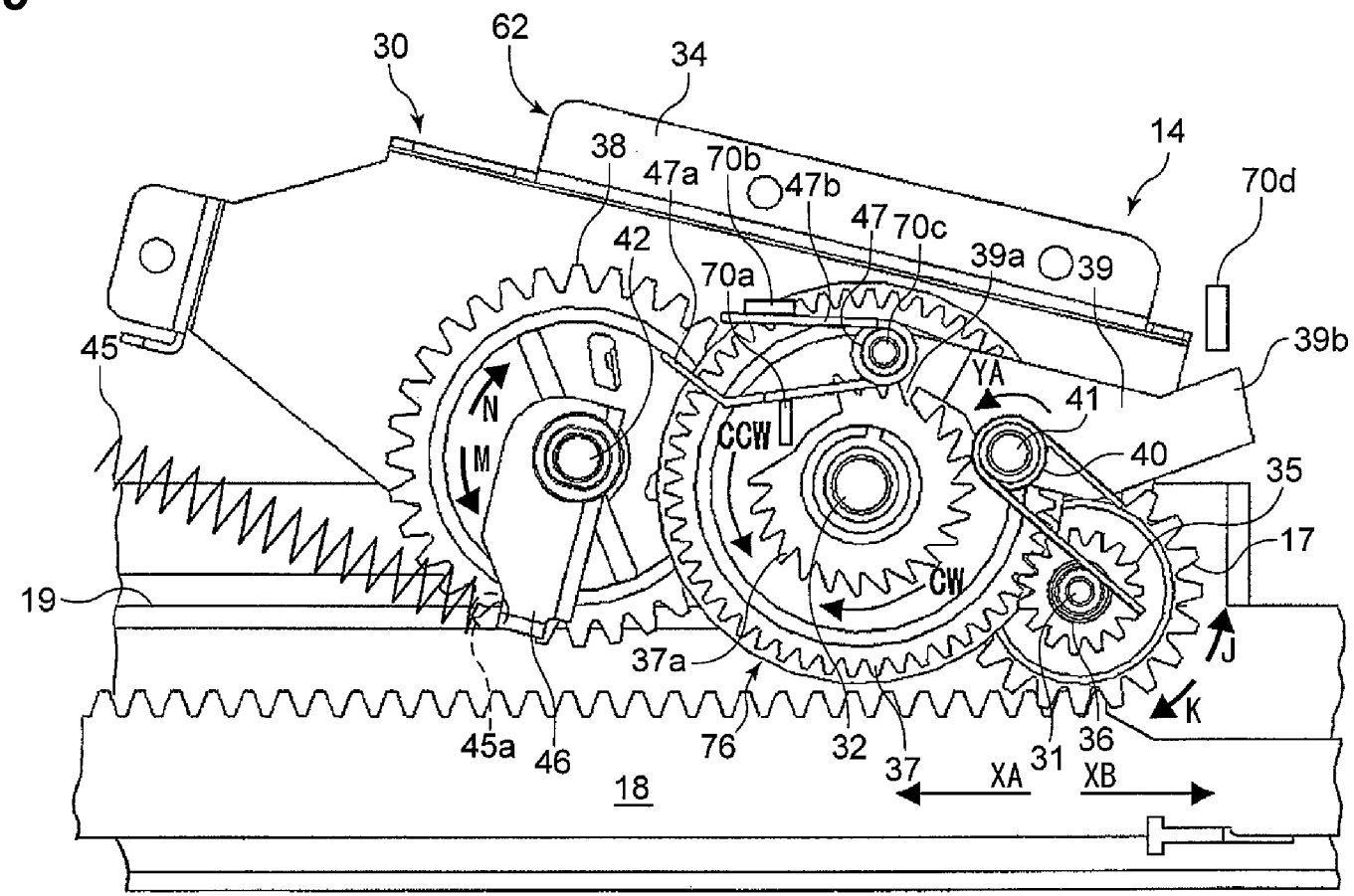
FIG. 8 is a state diagram of a state of the withdrawal mechanism when the sheet cassette is withdrawn from the sheet cassette frame.

Clutches 39*a* of the lock member 39 provided rotatably on the spindle 41 on the side plates 33 and 34 are engaged with a plurality of ratchets projection 37*a* of the ratchet stage gear 37 illustrated in FIG. 7. The lock member 39 is urged by a lock spring 40 to rotate around the spindle 41 in a direction of an arrow YA illustrated in FIG. 8, and the clutches 39*a* are engaged with the ratchets projection 37*a* so as to restrict the ratchet stage gear 37 from rotating in the direction of the arrow CCW. As illustrated in FIG. 8, a torsion spring is used as the lock spring 40, the input shaft 31 stops one end of the lock spring 40, and the lock member 39 stops the other end thereof, thereby always urging the lock member 39 to rotate in the direction of the arrow YA.

When the lock member 39 releases restriction of the rotation of the ratchet stage gear 37, a rotational end 39*b* of the lock member 39 abuts on an unlocking member 70*d* protruding from the fixed frame 70 to follow rotation of the oscillation unit 30 in the direction of the arrow CCW (FIGS. 7 and 8). In response to the abutment, as illustrated in FIG. 17, the lock member 39 rotates in a direction of an arrow YB to thereby disengage the clutches 39*a* from the ratchets projection 37*a*. Rotational operation performed by the oscillation unit 30 in the direction of the arrow CCW will be described later.

Figure 14:
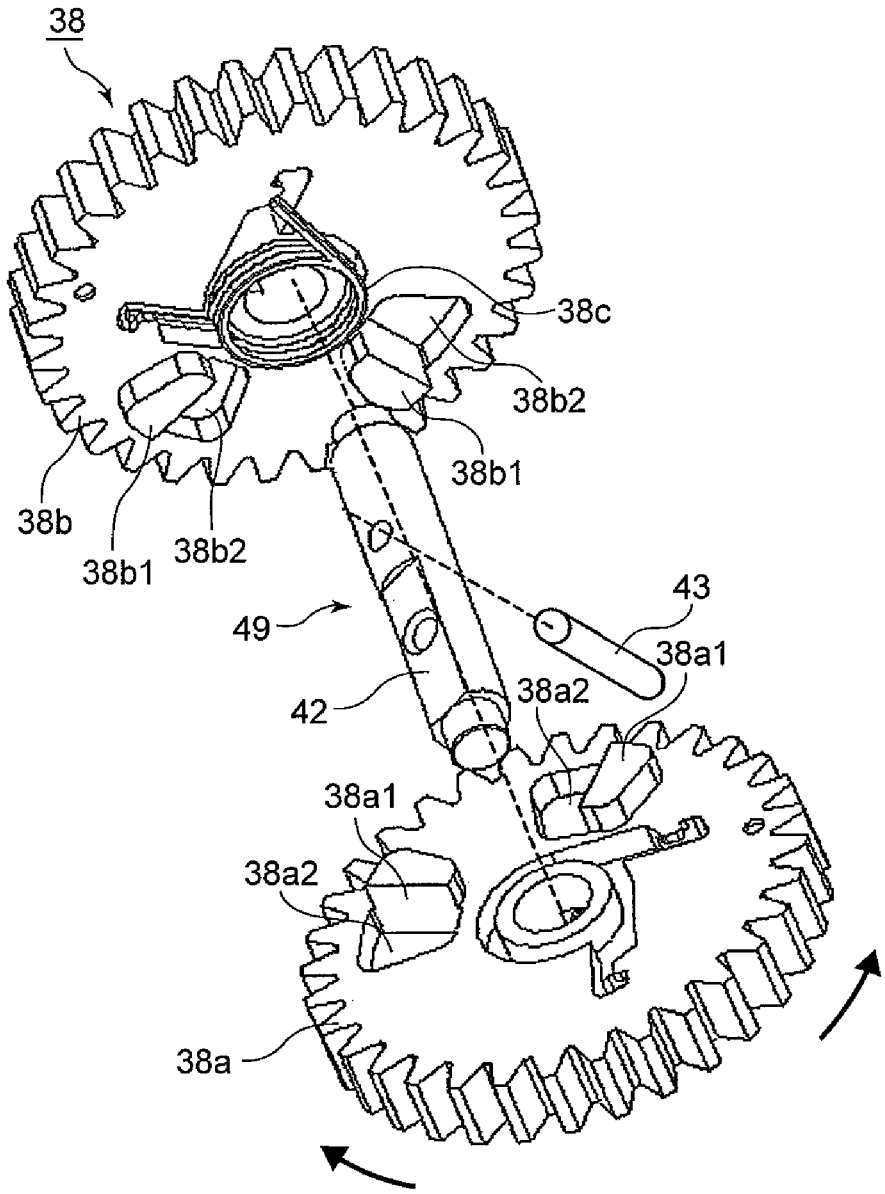
FIG. 14 is an exploded perspective view of a charge output gear.

As illustrated in a cross-sectional plan view of FIG. 11 and an exploded view of the charge output gear of FIG. 14, the charge output gear 38 is formed into a so-called scissors-gear obtained by a combination of two gears 38*a* and 38*b* and a torsion spring 38*c*. The input-side charge output gear 38*a* is engaged with the small-diameter gear 37*c* of the stage gear 37. The output-side charge output gear 38*b* is engaged with the rack 18 of the sheet cassette 4 when the oscillation unit 30 rotates in the direction of the arrow CCW illustrated in FIG. 7. The output-side charge output gear 38*b* is attached rotatably to the output shaft 42. The input-side charge output gear 38*a* is connected to the output shaft 42 by a parallel pin 43 (FIG. 14).

As illustrated in FIG. 14, the two gears 38*a* and 38*b* of the charge output gear 38 are combined by fitting of a boss into a concave portion. A boss 38*a*1 on a side surface of the input-side charge output gear 38*a* is fitted into a concave portion 38*b*2 on a side surface thereof in contact with the output-side charge output gear 38*b* at a certain gap kept therebetween. The boss 38*b*1 on the side surface of the output-side charge output gear 38*b* is fitted into a concave portion 38*a*2 on a side surface thereof in contact with the input-side charge output gear 38*a* at a certain gap kept therebetween. Such fitting gaps between the bosses and the concave portions allow the output-side charge output gear 38*b* to rotate with respect to the input-side charge output gear 38*a* by as much as a pitch of one gear tooth of the gear.

The lock member 39 restricts rotation of the charge-output gear 38 via the ratchet stage gear 37 when the oscillation unit 30 rotates to engage the charge-output gear 38 with the rack 18. Due to this, when the charge output gear 38 is engaged with the rack 18, engagement error may possibly occur. In addition, a gear module of the rack 18 and the charge output gear 38 needs at least a mechanical strength to the extent that gear teeth are not broken for transmitting a force necessary to accommodate the sheet cassette 4. Due to this, the module of the rack 18 and the charge output gear 38 is set to be relatively large. However, it is difficult for only an assembly backlash of the oscillation unit and a backlash between the rack 18 and the charge output gear 38 to absorb the engagement error. Accordingly, the charge output gear 38 is structured to absorb the engagement error by providing a scissors mechanism 49 having the torsion spring 38*c* sandwiched between the two gears 38*a* and 38*b*.

The charge input gear 17 is moved closer to the portion 18*a* (FIG. 10) of the rack 18 on which portion no teeth are formed during oscillation. Due to this, the charge input gear 17 is not engaged with gear teeth of the rack 18 and is not, therefore, formed into a scissors-gear shape. However, if the rack 18 does not include the portion 18*a* on which no gear teeth are formed, the charge input gear 17 is engaged with the rack 18. Therefore, the charge input gear 17 is not necessarily formed into the scissors-gear shape but preferably formed into the scissors-gear shape.

Moreover, if the charge input gear 17 and the output-side charge output gear 38*b* are formed into friction roller made of rubber or resin having high frictional coefficient and the rack 18 is formed into a friction plate made of resin having high frictional coefficient, there is no need to form the charge output gear 38 into the scissors-gear shape.

As illustrated in FIG. 7, a charge arm 46 is fixed to the output shaft 42. Due to this, the input-side charge output gear 38*a*, the output shaft 42, and the charge arm 46 rotate integrally. The charge spring 45 is provided between a tip end of the charge arm 46 and a rear end of the side plate 33 of the oscillation unit 30. The charge spring 45 is a tension spring. When the charge output gear 38 rotates, the charge arm 46 also rotates via the output shaft 42 to pull up the charge spring 45. Accordingly, energy is charged in the charge spring 45. This charged energy is used to make a force of pushing the sheet cassette 4 into the apparatus main body almost uniform. This feature will be described later in detail.

A torsion spring 47 (FIG. 8) determining a limit to an amount of the energy charged in the charge spring 45 is provided on a pin 70*c* (FIGS. 6 and 8 to 10) fastened to the fixed frame 70. A protrusion 70*a* of the fixed frame 70 stops one end 47*a* of this torsion spring 47 and a projection 70*b* of the fixed frame 70 stops the other end 47*b* thereof normally (during no-charge operation). The projections 70*a* and 70*b* are provided on the fixed frame 70 to protrude toward the ratchet stage gear 37.

The relationship among the charge arm 46, the charge spring 45, the oscillation spring 71 serving as the oscillation elastic member, and the torsion spring 47 will be described.

Figure 9:
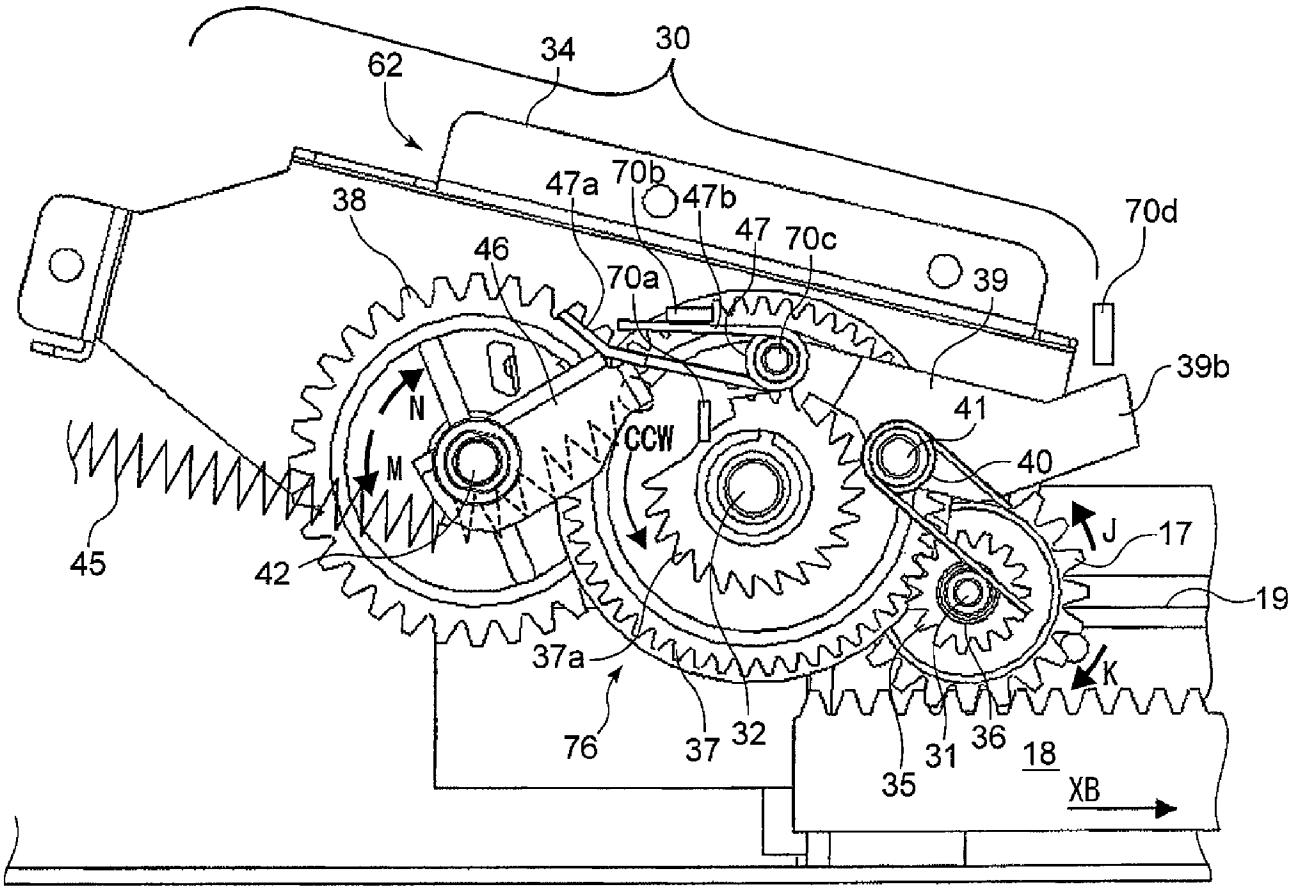
FIG. 9 is a state diagram, subsequent to the state of FIG. 8, of a state of the withdrawal mechanism when the sheet cassette is withdrawn from the sheet cassette frame.

The charge output gear 38 and the charge arm 46 rotate in a direction of an arrow M illustrated in FIGS. 8 and 9 while charging energy in the charge spring 45 by rotation of the reduction gear train 76 including the gears 17, 35, 37, and 38. The charge arm 46 abuts on one end 47*a* of the torsion spring 47 halfway along rotation in the direction of the arrow M.

As illustrated in FIG. 6, the oscillation unit 30 is provided to rotate about the oscillation central shaft 32 on the fixed frame 70. Normally, the oscillation unit 30 is pulled by the oscillation spring 71 provided between the oscillation unit 30 and the fixed frame 70 and urged to rotate in the direction of the arrow CW.

The charge arm 46 continuously rotates to abut on one end 47*a* of the torsion spring 47, the end 47*a* separates from the protrusion 70*a* to bend the torsion spring 47 while being closer to the other end 47*b* of the torsion spring 47. Due to this, the oscillation unit 30 receives a rotational force in the direction of the arrow CCW by the torsion spring 47 for rotation around the oscillation central shaft 32. However, the shaft end 31*a* of the input shaft 31 is engaged with the linear groove 19*a* (FIG. 16) of the oscillation switching groove 19. Due to this, a force for rotating the oscillation unit 30 in the direction of the arrow CCW is charge in torsion spring 47. The charge rotational force in the direction of the arrow CCW is used to rotate the oscillation unit 30 in the direction of the arrow CCW at a final stage of pushing the sheet cassette 4 into the apparatus main body.

The charge arm 46 not only bends the torsion spring 47 but also continuously pulls the charge spring 45 to charge energy in the charge spring 45. In this case, as illustrated in FIG. 9, the energy is charge in the charge spring 45 while the charge input gear 17 is engaged with the rack 18. When the energy is charge in the charge spring 45, a reversal force (force in a direction of an arrow N) of the charge output gear 38 increases. Even if the reversal force increases, the charge output gear 38 is prevented from rotating inversely because of engagement of the lock member 39 with the ratchets projection 37*a* of the ratchet stage gear 37.

That is, the lock member 39 is engaged with the ratchet stage gear 37 included in the reduction gear train 76, and the charge input gear 17 interlocks with the sheet cassette moving in one direction to prevent the reduction gear train 76 in a stage of charging the energy in the charge spring 45 from rotating inversely.

The lock member 39, the lock spring 40, the ratchets projection 37*a* and the like form lock unit for locking the charge spring 45 in a state of being charged with energy.

Thereafter, when the energy charged in the charge spring 45 reaches a predetermined charge amount, it is necessary to prevent the charge arm 46 from performing charge operation any longer. Due to this, a limit mechanism 85 (FIG. 13) is provided on the reduction gear train 76. The limit mechanism 85 includes the ratchet mechanism 75 moving the ratchet gear 35 in a thrust direction and a rib 37*b* of the ratchet stage gear 37. A tapered portion 37*ba* protruding in a tapered fashion is formed at a certain phase angle position of the rib 37*b* of the ratchet stage gear 37. When the tapered portion 37*ba* of this rib 37*b* abuts on the rib 35*a* of the ratchet gear 35, the ratchet gear 35 is thrust to move in the direction of the arrow ZA. Accordingly, the rib 35*a* of the ratchet gear 35 is disengaged from the ratchets projection 17*a* of the charge input gear 17, turning the charge input gear 17 into an idle state. As a result, the rotational force of the charge input gear 17 at the time of withdrawing the sheet cassette 4 is not transmitted to the charge arm 46 via the reduction gear train 76 including the gears 17, 35, 37, and 38 and the energy of an amount equal to or larger than the predetermined amount is not charged in the charge spring 45.

The limit mechanism 85 is provided to prevent an excessive pulling force from being applied to the charge spring 45 and the withdrawal mechanism 14 from being damaged depending on user's withdrawal or accommodation operation for the sheet cassette 4. The limit mechanism 75 is not always necessary depending on strength of the structure.

(Operation Performed by Withdrawal Mechanism 14)

A series of operation performed by the withdrawal mechanism 14 will be described with reference mainly to FIG. 16.

FIG. 16 illustrates that the input shaft 31 moves for brevity. While describing the operation performed by the withdrawal mechanism 14 with reference to FIG. 16, it is often assumed that the oscillation switching groove 19 is fixed and that the input shaft 31 is movable. This assumption is made for brevity of description. Nevertheless, it is true that the oscillation switching groove 19 and the rack 18 move integrally with the sheet cassette 4 in the directions of the arrows XA and XB and the input shaft 31 moves vertically.

(Withdrawal Operation Performed by the Withdrawal Mechanism 14 for Withdrawing the Sheet Cassette 4)

Generally, the latch member 24 (FIG. 5) holds the input shaft 31 at a position indicated by symbol E ("position E"). The position E corresponds to the feed operation position, accommodation position, and position from which sheets S can be fed to the image formation unit 101 (FIG. 1) illustrated in FIG. 5. At this time, as illustrated in FIG. 8, the oscillation unit 30 is pulled by the oscillation spring 71 (FIG. 6) to urge the oscillation unit 30 to rotate about the oscillation central shaft 32 in the direction of the arrow CW. Due to this, the charge input gear 17 is engaged with the rack 18.

If the user depresses the button 20 (FIGS. 4 and 5) in a state in which the sheet cassette 4 is held at the accommodation position E, the latch member 24 rotates about the boss 24*a* clockwise and detaches from the latch shaft 21. Accordingly, the sheet cassette 4 is pushed out (moved) in the direction of the arrow XB by the push spring 48 (FIG. 4) provided between the sheet cassette frame 11 and the sheet cassette 4. At that time, the input shaft 31 of the withdrawal mechanism 14 moves in a direction of an arrow h in the linear groove 19*a* of the oscillation switching groove 19 illustrated in FIG. 16. When the input shaft 31 reaches a position indicated by symbol A ("position A") illustrated in FIG. 16, the push spring 48 (FIG. 4) finishes push-out operation. The push spring 48 can easily withdraw the sheet cassette 4 with an inexpensive and simple configuration. Thereafter, when the user manually withdraws the sheet cassette 4 in the direction of the arrow XB, the input shaft 31 moves in a direction of an arrow a. If the user further withdraws the sheet cassette 4 in the direction of the arrow XB, the input shaft 31 moves in a direction of an arrow C. If the user further pulls the sheet cassette in the direction of the arrow XB, then the input shaft 31 moves in a direction of an arrow c, thereby enabling the sheet cassette 4 from being withdrawn from the sheet cassette frame 11. However, if the sheet cassette 4 cannot be withdrawn from the sheet cassette frame 11, the user stops withdrawing the sheet cassette at the moment the input shaft 31 moves to the withdrawal position C.

While the input shaft 31 moves to the withdrawal position C from the accommodation position E, the oscillation unit 30 is urged to rotate in the direction of the arrow CW by the oscillation spring 71 (FIG. 6), and the input shaft 31 is engaged with the linear groove 19*a* of the oscillation switching groove 19. Due to this, the charge input gear 17 keeps engaged with the rack 18, and the position at which the charge input gear 17 is engaged with the rack 18 moves from a front-side (withdrawal-side) position illustrated in FIG. 8 to a depth-side (push-in-side) position illustrated in FIG. 9. During this time, the charge input gear 17 rotates in the direction of the arrow J to rotate the charge output gear 38 and the charge arm 46 in the direction of the arrow M. As a result, energy is charge in the charge spring 45.

That is, the charge spring 45 serving as the charge elastic member is charged with energy according to movement of the sheet cassette 4 serving as the slide unit in the withdrawal direction (the direction of the arrow XB, another direction).

Moreover, while the sheet cassette 4 moves from the accommodation position E to the withdrawal position C, the lock member 39 is sequentially engaged with the rotating ratchets projection 37*a*. Due to this, the charge output gear 38 is attracted by the charge spring 45 and prevented from rotating oppositely in the arrow M direction. As a result, maximum energy is charged in the charge spring 45 when the input shaft 31 is at the withdrawal position C without releasing the energy charged in the charge spring 45. At this time, if energy of an amount equal to or larger than a set value is charged in the charge spring 45, the limit mechanism 84 discharges the energy of an excessive amount, thereby preventing the withdrawal mechanism 60 from being damaged.

Further, in the state of FIG. 9, the torsion spring 48 applies the rotational force in the direction of the arrow CCW to the oscillation unit 30. However, because of engagement of the input shaft 31 with the linear groove 19*a* of the oscillation switching groove 19, the oscillation unit 30 is prevented from rotating in the direction of the arrow CCW, thereby keeping engagement of the charge input gear 17 with the rack 18.

(Accommodation Operation Performed by the Withdrawal Mechanism 14 for Accommodating the Sheet Cassette 4)

When the sheet cassette 4 is pushed into the sheet cassette frame 11 (FIG. 2) from the withdrawal position C, the input shaft 31 moves from the withdrawal position C illustrated in FIG. 16 in a direction of an arrow d. At this time, if a charge amount of charging the charge spring 45 reaches a charge limit amount and one end 47*a* of the torsion spring 47 is pushed away by the charge arm 46, the torsion spring 47 urges the oscillation unit 30 to rotate in the direction of the arrow CCW. "To reach the charge limit amount" means that predetermined energy is charged. However, because of engagement of the input shaft 31 with the linear groove 19*a*, the oscillation unit 30 is restricted from rotating in the direction of the arrow CCW When the input shaft 31 reaches a branch point B, the input shaft 31 is disengaged from the linear groove 19*a* and the torsion spring 47 rotates the oscillation unit 30 in the direction of the arrow CCW against the oscillation spring 71 (FIG. 6). Accordingly, the input shaft 31 enters the branch groove 19*b* and moves in a direction of an arrow f.

Figure 10:
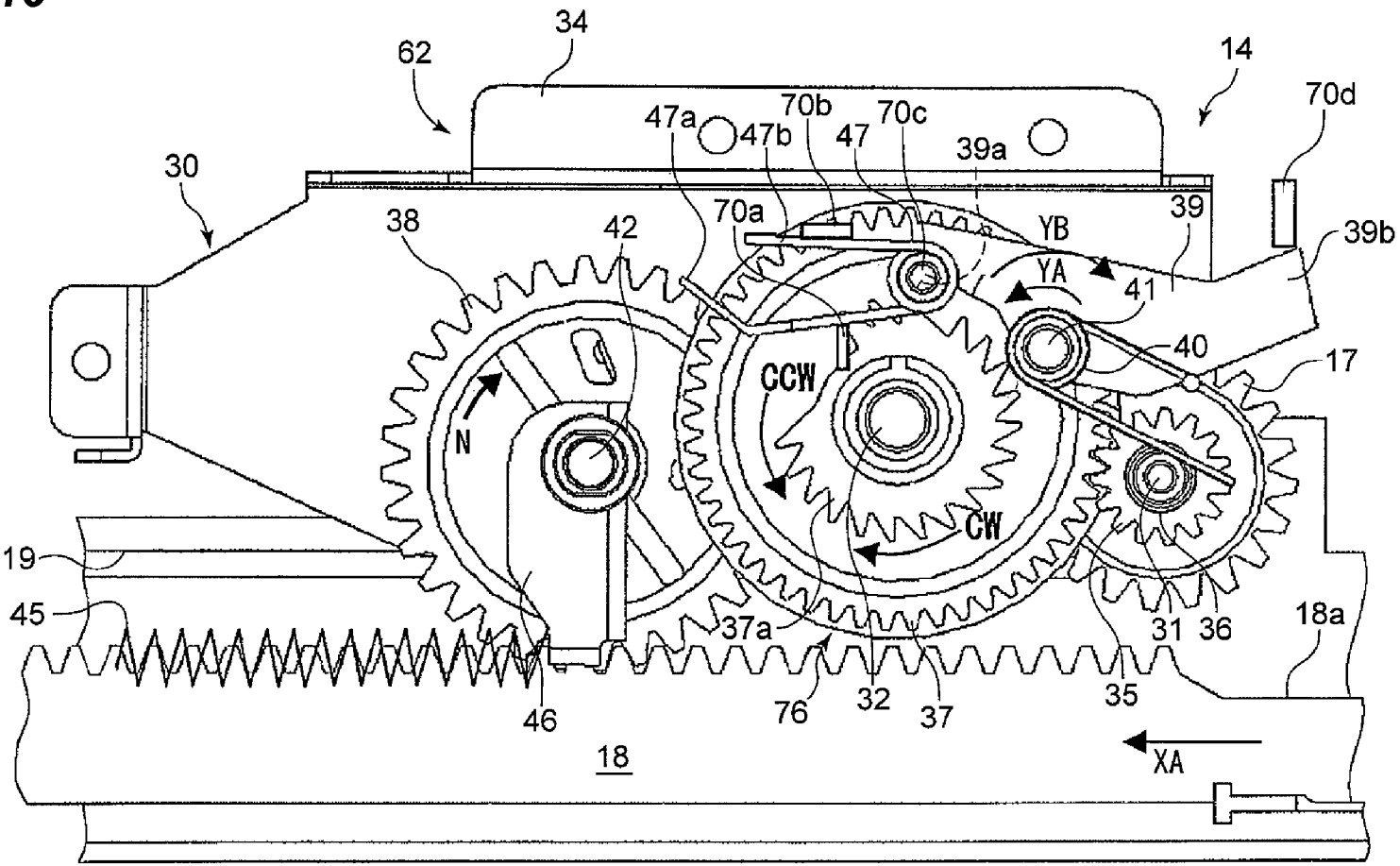
FIG. 10 is a state diagram of a state in which the sheet cassette is pushed into and dragged into the sheet cassette frame by a charge spring from the state of FIG. 9.

While the input shaft 31 moves from the branch point B in the direction of the arrow f and reaches a position indicated by symbol D ("position D"), the oscillation unit 30 rotates in the direction of the arrow CCW as illustrated in FIG. 10 and the rotational end 39*b* of the lock member 39 abuts on the unlock member 70*d* of the fixed frame 70. The lock member 39 rotates in the direction of the arrow YB to follow rotation of the oscillation unit 30 in the direction of the arrow CCW. As a result, the clutches 39*a* (FIG. 8) of the lock member 39 are disengaged from the ratchets projection 37*a* of the ratchet stage gear 37, thereby releasing restriction of the ratchet stage gear 37 from rotating inversely. That is, the lock member 39 is provided in the fixed frame, and abuts when the oscillation unit oscillates by abutment of the branch groove 19*b* on the shaft end 31*a* in a final stage of moving the sheet cassette 4 in another direction. As a result, the lock member 39 detaches from the reduction gear train 76. On the other hand, when the oscillation unit 30 rotates in the direction of the arrow CCW as illustrated in FIG. 10, the output-side charge output gear 38*b* is engaged with the rack 18.

The shaft end 31*a* of the input shaft 31, the branch groove 19*b*, and the rotational end 39*b* of the lock member 39 serving as abutment portions, the unlock member 70*d* and the like serving as abutment target portions form unlocking unit. The input shaft 31, the branch groove 19*b*, the rotational end 39*b*, and the unlock member 70*d* interlocks the sheet cassette 4 with the charge spring and unlock at the final stage of moving the sheet cassette 4 in the direction of the arrow XB (another direction).

When the lock member 39 releases restriction of the ratchet stage gear 37 from rotating inversely, the charge force charged in the charge spring 45 is released to rotate the charge arm 46 and the input-side charge output gear 38*a* in the direction of the arrow J in FIG. 10. Accordingly, the output-side charge output gear 38*b* also rotates in the direction of the arrow J via engagement of the boss 38*a*1 with the concave portion 38*a*2 and that of the boss 38*b* with the concave portion 38*b*2 in the scissors-gear mechanism 49 illustrated in FIG. 14.

Because of engagement of the output-side charge output gear 38*b* with the rack 18, the output-side charge output gear 38*b* moves the sheet cassette 4 in a direction of an arrow XA via the rack 18, thereby pulling in the sheet cassette frame 11. Therefore, the position D is the pull-in start position at which the sheet cassette 4 is pushed into the sheet cassette frame 11 by the user and automatically starts to be pulled in the sheet cassette frame 11 by a pull-in force charged in the charge spring 45.

Further, while the position D differs from the position A in vertical direction, the positions A and D are the same in withdrawal and push-in direction of withdrawing and pushing the sheet cassette 4 from and into the cassette frame 11.

When the sheet cassette 4 is moved in the pull-in direction XA, the input shaft 31 relatively moves in a direction of an arrow g. When the input shaft 31 reaches a position indicated by symbol Da ("position Da"), the charge force charged in the charge spring 45 is discharged. In addition, the charge arm 46 rotates at a position away from the torsion spring 47. Therefore, the oscillation unit 30 is pulled by the oscillation spring 71 and, as illustrated in FIG. 8, rotates again in the direction of the arrow CW. Accordingly, the sheet cassette 4 moves to the accommodation position E with respect to the input shaft 31, the output-side charge output gear 38*b* separates from the rack 18, and the input gear 17 is engaged with the rack 18. In addition, the rotational end 39*b* of the lock member 39 separates from the unlock member 70*d*, the lock member 39 is rotated in the direction of the arrow YA by the lock spring 40, and the lock member 39 engages the clutches 39*a* with the ratchets projection 37*a*. When the sheet cassette 4 moves to the position Da with respect to the input shaft 31, the accommodation position holding mechanism 80 (FIG. 5) latches and holds the sheet cassette 4 so as not to unnecessarily protrude from the sheet cassette frame 11.

Meanwhile, in the above-stated operation, the user often withdraws the sheet cassette 4 halfway, at which position, the user pushes the sheet cassette 4 into the sheet cassette frame. In this case, a withdrawal distance of the sheet cassette 4 is insufficient, so that the charge amount of charging the charge spring 45 does not often reach the charge limit amount. If the charge amount is insufficient, an urging force of the torsion spring 47 in the direction of the arrow CCW applied to the oscillation unit 30 is lower than the pulling force of the oscillation spring 71. As a result, the oscillation unit 30 is urged to rotate in the direction of the arrow CW by the oscillation spring 71. Due to this, even if the input shaft 31 reaches the branch point B, the input shaft 31 cannot move in the direction of the arrow f and, therefore, continues to move in the linear groove 19*a* in a direction of an arrow e. In this case, because of the insufficient charge amount of the charge spring 45, the user is required to manually push the sheet cassette 4 into the sheet cassette frame 11.

It is to be noted that the oscillation spring (FIG. 6) is a tension spring spread between the oscillation unit 30 and the fixed unit 70, and applies the rotational force in the direction of the arrow CW to the oscillation unit 30 by the lower pulling force than that of the torsion spring 47.

Providing that the input shaft 31 is moved in the direction of the arrow f despite the insufficient charge amount of the charge spring 45, the sheet cassette 4 cannot be pulled into the accommodation position E at which the accommodation position holding mechanism 80 (FIG. 5) latches the sheet cassette 4 in the pull-in operation by the charge output gear 38. Due to this, the user possibly does not notice that the sheet cassette 4 stops halfway before reaching the accommodation position E, and possibly misrecognizes that the sheet cassette 4 is latched by the accommodation position holding mechanism 80 (FIG. 5). To prevent such misrecognition, the input shaft 31 is moved in the direction of the arrow e to prevent the charge output gear 38 from performing the pull-in operation. In addition, in a state in which a protrusion amount of the sheet cassette 4 from the sheet cassette frame 11 is large, the pull-in of the sheet cassette 4 is stopped. Thereafter, the user pushes the sheet cassette 4 into the sheet cassette frame.

In this way, the torsion spring 47 is elastically deformed by the charge arm 46 rotating according to rotation of the reduction gear train 75. When the charge amount of the charge spring 45 is insufficient, no pull-in force of the charge spring 45 is applied to the sheet cassette 4. Due to this, the torsion spring 47 is a charge amount determination elastic member determining whether or not the charge amount of the charge spring 45 reaches the limit amount and functioning to prevent a sheet cassette accommodation operation error.

As stated above, the withdrawal mechanism 14 performs a charge operation and a charge release operation on the oscillation unit 30 according to engagement of the input shaft 31 with the sheet cassette oscillation switching groove 19 at the time of a pull-out operation and an accommodation operation (push-in operation) for the sheet cassette 4.

Figure 15:
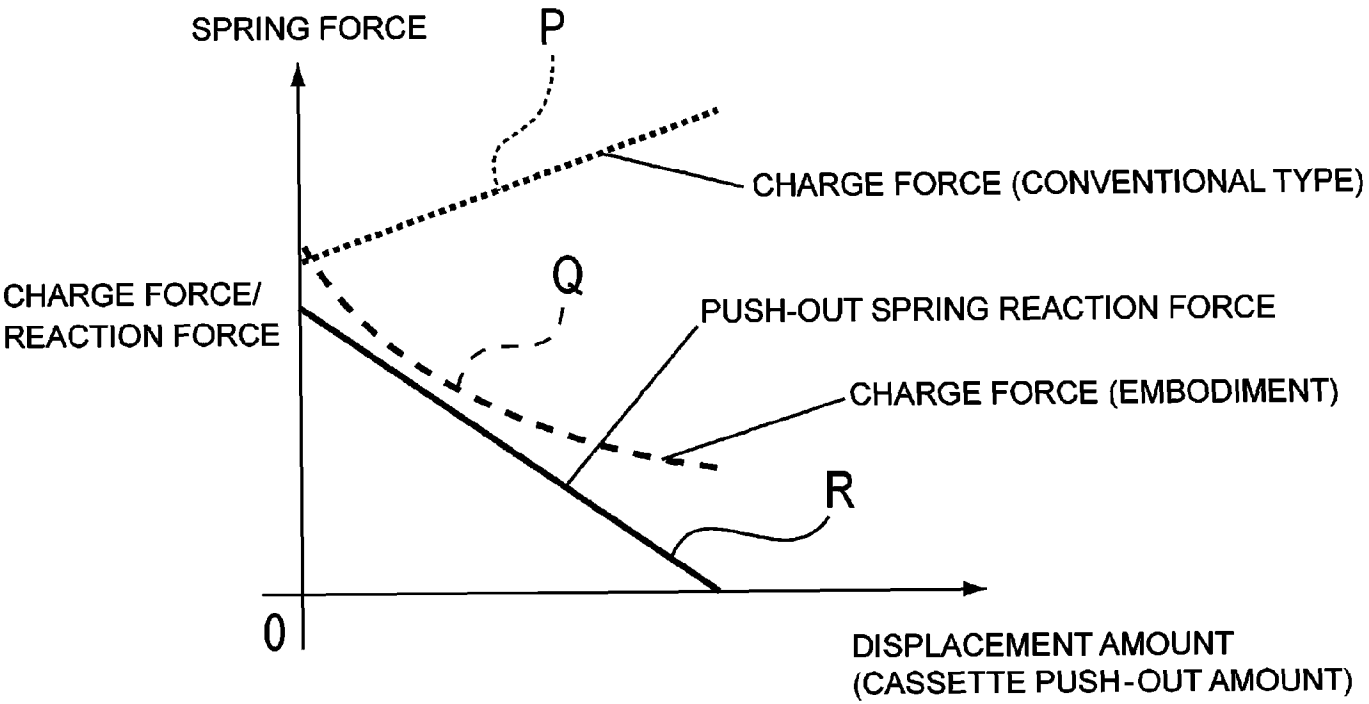
FIG. 15 is a diagram illustrating relationship between an elastic force of a push spring and a charge force of the charge spring.

FIG. 15 illustrates relationship between an elastic force of the push spring 48 provided between a rear end of the sheet cassette 4 (FIG. 4) and the sheet cassette frame 11 and pushing out the sheet cassette 4 and a charge force of the oscillation unit 30 (charge spring 45).

The push spring 48 functions to push out the sheet cassette 4 when the user withdraws the sheet cassette 4. Therefore, if the sheet cassette 4 is accommodated in the sheet cassette frame 11, it is required to push the sheet cassette 4 with a higher force than the elastic force of the push spring 48 and to accommodate the sheet cassette 4 into the sheet cassette frame 11. Besides, as indicated by a line P illustrated in FIG. 15, the push force of pushing the sheet cassette 4 should be increases as push-in operation proceeds.

Due to this, for the charge spring 45 to pull the sheet cassette 4 into the sheet cassette frame 11 against the push spring 48, the charge force of the charge spring 45 should be higher than a maximum elastic force of the push spring 48. It is when the sheet cassette 4 is withdrawn when the charge spring 45 is charged with energy. In addition, an elastic member such as a spring normally has a property to linearly increase reactive force according to an increase of a moving amount. Due to this, if the charge spring 45 is linearly pulled along a longitudinal direction, the withdrawal force of withdrawing the sheet cassette 4 linearly increases. Finally, it is necessary to withdraw the sheet cassette 4 with a higher force than that of the push spring 48. This deteriorates operability at the time of withdrawing the sheet cassette 4.

Considering these, the withdrawal mechanism 14 according to this embodiment is structured to be able to withdraw the sheet cassette 4 with hardly changing the withdrawal force of withdrawing the sheet cassette 4 even if the sheet cassette 4 is withdrawn and the charge amount of the charge spring 45 is increased.

The structure of the withdrawal mechanism 14 will be described. The charge spring (FIG. 7) is a tension spring, one end of the charge spring 45 is provided on a tip end of the charge arm 46, and the other end thereof is provided on a rear end of the side plate 33 of the oscillation unit 30.

When the sheet cassette 4 is pushed into the sheet cassette frame 11, the charge arm 46 rotates by about 90 degrees in a direction of an arrow M and one end 45*a* of the charge spring 45 is received by the output shaft 42 so as to be wound around the output shaft 42. Accordingly, at an initial state of rotating the charge arm 46, a pulling direction of the charge spring 45 is set at about 90 degrees with respect to the charge arm 46. However, there is no need to increase a rotational moment of the charge arm 46 at this stage since the pulling force of the charge spring 45 is still low.

Thereafter, the charge arm 46 rotates and pulls the charge spring 45 as the sheet cassette 4 is pushed into the sheet cassette frame 11. Due to this, it is necessary to increase the rotational moment of the charge arm 46. However, one end 45*a* of the charge spring 45 is located on an opposite side to the other end 45*b* thereof across the output shaft 42 as a central position of rotation of the output charge gear 48. Due to this, the pulling force of the charge spring 45 applied to the charge arm 46 acts on a direction along the longitudinal direction of the charge arm 46. It is, therefore, possible to charge energy in the charge spring 45 with hardly increasing the rotational moment of the charge arm 46.

Figure 17A:
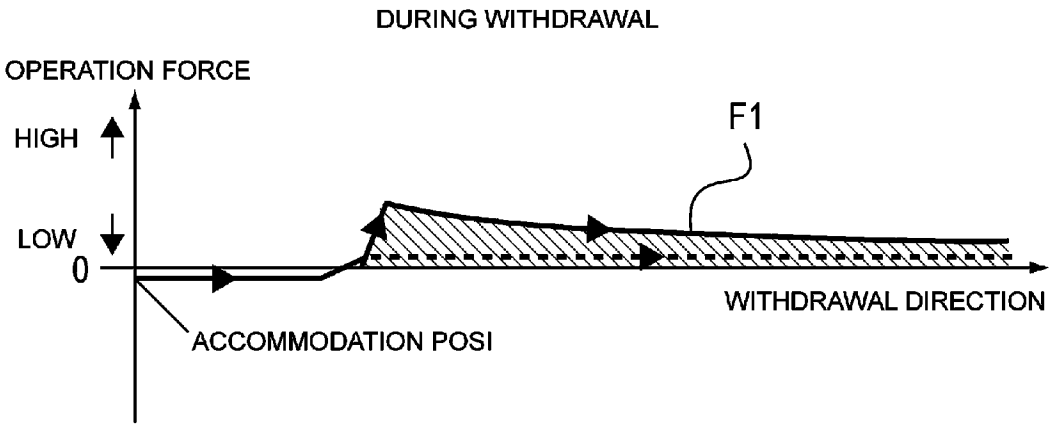
FIG. 17A is the diagram when the sheet cassette is withdrawn and FIG. 17B is the diagram when the sheet cassette is contained.

In this way, the withdrawal mechanism 14 hardly needs to change the sheet cassette pulling force even if the user withdraws the sheet cassette 4 and the charge amount of the charge spring 45 is increased (FIG. 17A). Therefore, the withdrawal mechanism 14 is excellent in withdrawal operability when withdrawing the sheet cassette 4.

Moreover, the configuration in which the charge spring 45 is pulled so as to be wound around the output shaft 42 produces the following advantages when the sheet cassette 4 is pushed into the sheet cassette frame 11.

If the sheet cassette 4 is pushed into the sheet cassette frame 11 and the energy charged in the charge spring 45 is released at a final push-in stage, the charge spring 45 pulls the charge arm 46 in a state in which the output shaft 42 receives one end 45*a* of the output shaft 42.

At this time, the pulling force of the charge spring 45 is high. However, since the pulling force acts along the longitudinal direction of the charge arm 46, the pulling force of the charge spring 45 does not effectively act on the charge arm 46 and the rotational moment is low. As illustrated in FIG. 10, if the charge spring 45 rotates the charge arm 46 in the direction of the arrow J and located at about 90 degrees with respect to the charge arm 46, the pulling force of the charge spring 45 decreases but the pulling force thereof effectively acts on the charge arm 46. Due to this, the charge force of pulling the sheet cassette 4 into the sheet cassette frame 11 changes as indicated by a curve Q illustrated in FIG. 15 without suddenly reducing the rotation moment acting on the charge arm 46. In addition, the charge force can be reduced with small loss with respect to the reaction force of the push spring 48 as indicated by a line R illustrated in FIG. 15.

Figure 17B:
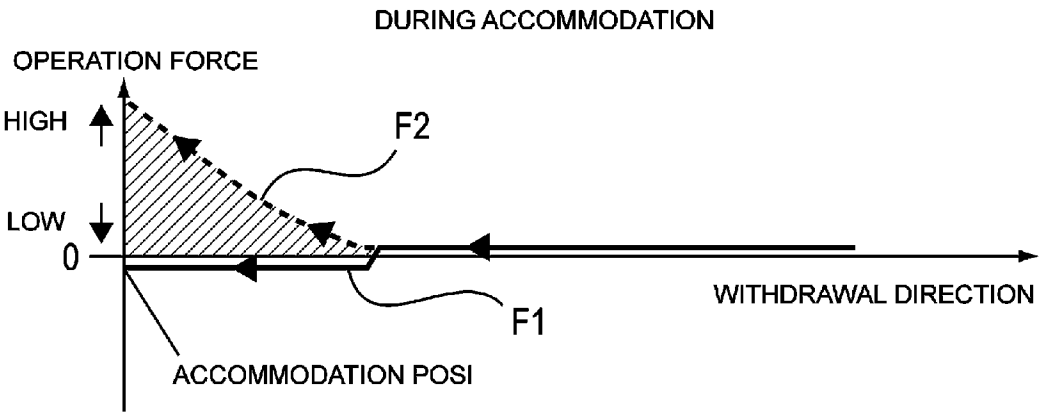

In the withdrawal mechanism 14 stated above, the pull-in start position D is located toward a withdrawal side (forward) in relation to a central position between the accommodation position E and the withdrawal position C that central position indicates a withdrawal stroke of the sheet cassette 4. Due to this, as indicated by FIG. 17A illustrating the relationship between an operation force during operation of withdrawing the sheet cassette 4 and that of accommodating the sheet cassette 4, workload necessary to accommodate the sheet cassette 4 is produced using a long stroke with a low force as much as possible at the time of the operation of withdrawing the sheet cassette 4. As illustrated in FIG. 17B, the workload is discharge halfway during accommodation of the sheet cassette 4.

Accordingly, a sudden change in an absolute value of an operation force F1 of the sheet cassette device 10 according to this embodiment occurs less frequently than that of an operation force F2 of a sheet cassette device configured to include only the push spring without using the withdrawal mechanism 14 according to this embodiment. Therefore, the sheet cassette device 10 according to this embodiment enables the user to feel comfortable withdrawal operability and accommodation operability without causing the user to feel an uncomfortable and high operation force.

Besides, in the reduction gear train 76, the charge output gear 38 rotates at a lower velocity than that of the charge input gear 17. Due to this, even if a withdrawal force of the charge spring 45 for withdrawing the sheet cassette 4 is low, energy of a sufficient charge amount can be charged in the charge spring 45 due to a long withdrawal stroke.

Moreover, the charge spring 45 has the charge amount set larger than a discharge force accumulated in the push spring 48 so as to pull the sheet cassette 4 into the sheet cassette frame 11 against the push spring 48. Nevertheless, if the charge amount is released, there is a probability that the sheet cassette 4 is pushed back by the push spring 48 and protrudes from the sheet cassette frame 11.

Due to this, when a relative positional relationship between the input shaft 31 and the oscillation switching groove 19 is on a line S passing the accommodation position E illustrated in FIG. 16 and set at right angle with respect to the oscillation holding groove 19*c*, the accommodation position holding mechanism 80 holds the sheet cassette 4 at the position at which the sheet cassette 4 is pulled into the sheet cassette frame 11. This can prevent the sheet cassette 4 from being pushed out by the push spring 48.

Furthermore, the charge spring 45 often suddenly pulls the sheet cassette 4 into the sheet cassette frame 11. Considering this, a dumper gear (not illustrated) including a viscous dumper function and serving as a dumper rotating member may be arranged to be engaged with one of the gears included in the reduction gear train 76 so as to prevent the withdrawal mechanism 14 from being damaged by sudden pulling of the sheet cassette 4 into the sheet cassette frame 11. The dumper gear temporarily absorbs energy of sudden rotation of the gears 17, 37, and 38 and the charge arm 46 and then discharge the energy gradually.

Figure 18:
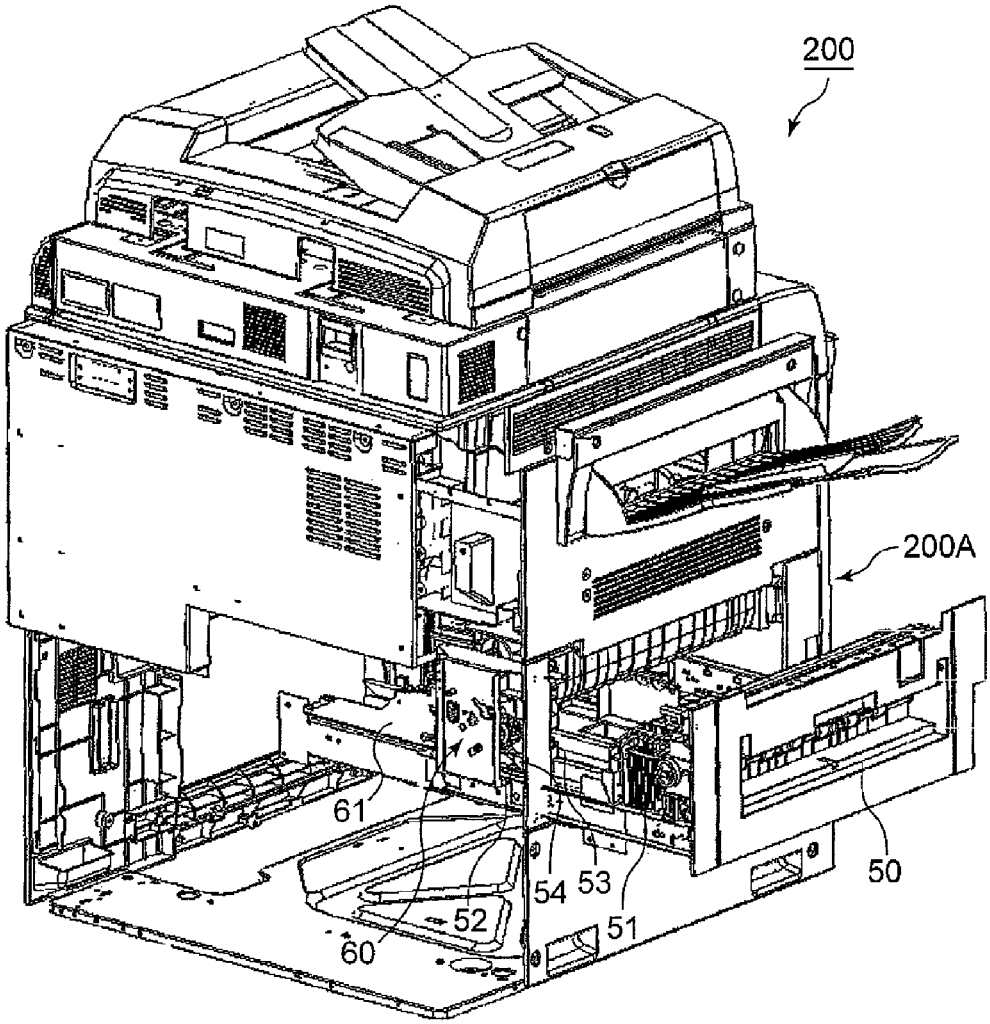
FIG. 18 is a diagram illustrating an instance of providing the drag-in mechanism according to the embodiment in a withdrawable sheet conveyance unit including a fixing unit.

The withdrawal mechanism 14 stated above is applicable not only to the pull-in operation of pulling the sheet cassette 4 into the sheet cassette frame 11 but also, as indicated by an image formation apparatus 200 illustrated in FIG. 18, to a withdrawal sheet conveyance unit 50 including a fixing unit 51 corresponding to the fixing member 109 illustrated in FIG. 1.

The sheet conveyance unit 50 is structure to be able to withdraw a sheet so that a user or a serviceman can easily remove the sheet when a sheet jam occurs to the fixing unit 51.

In FIG. 18, a withdrawal mechanism 60 and an oscillation unit 61 as a part of the slide unit moving device are configured similarly to the withdrawal mechanism 14 and the oscillation unit 30 described with reference to FIGS. 1 to 17. The sheet conveyance unit 50 serving as the slide unit is held on slide rails 52, and configured to be able to easily perform an accommodation operation and a withdrawal operation by slidable movement of the slide rails 52.

The sheet conveyance unit 50 includes an oscillation switching groove 53 and a rack 54 similar to the oscillation switching groove 19 and the rack 18. When the sheet conveyance unit 50 is withdrawn, a withdrawal force is charged (accumulated) in a withdrawal mechanism 60 attached to a rear side plate of a main body frame (not illustrated). When a user accommodate the sheet conveyance unit 50 in an apparatus main body 200A, the withdrawal mechanism 60 pulls the sheet conveyance unit 50 into the apparatus main body 200A using the withdrawal force changed in the withdrawal mechanism 60.

In this way, the withdrawal mechanism according to this embodiment is applicable not only to the sheet cassette but also to the sheet conveyance unit and is not limited to the sheet cassette.

The withdrawal mechanism according to this embodiment pulls the sheet cassette or sheet conveyance unit into the sheet cassette frame or apparatus main body at end of pushing the sheet cassette or sheet conveyance unit after the user or serviceman finishes a removal operation of removing a sheet when a sheet jam occurs or finishes maintenance operation. Due to this, the withdrawal mechanism enables the user to feel comfortable withdrawal operability and accommodation operability without causing the user to feel an uncomfortable and high operation force.

In the description so far, the withdrawal mechanism 14 or 60 serving as the slide unit moving device is configured to charge energy in the spring during withdrawal of the sheet cassette 4 or sheet conveyance unit 50, and to automatically pull the sheet cassette 4 or sheet conveyance unit 50 into the sheet cassette frame 11 or apparatus main body 200A using the energy charged in the spring at end of accommodation. However, if the withdrawal mechanism 14 or 60 is provided back to front, the withdrawal mechanism 14 or 60 can perform an opposite operation to that stated above. Therefore, the operation performed by the withdrawal mechanism 14 or 60 is not limited to that stated above. That is, the withdrawal mechanism 14 or 60 can charge energy in the spring when the sheet cassette 4 or sheet conveyance unit 50 is accommodated in the sheet cassette frame 11 or apparatus main body 200A, and can be automatically pushed out using the energy charged in the spring at end of withdrawal.

The withdrawal mechanism 14 or 60 withdraws the sheet cassette 4 or sheet conveyance unit 50 in a longitudinal direction. Alternatively, the withdrawal mechanism 14 or 60 is applicable to an instance in which the sheet cassette 4 or sheet conveyance unit 50 is withdrawn in a transverse direction. In another alternative, the withdrawal mechanism 14 or 60 is applicable to an instance in which the sheet cassette 4 or sheet conveyance unit 50 moves aslant with respect to a vertical direction or moves in the vertical direction. In this case, the sheet cassette 4 or sheet conveyance unit 50 tends to move downward due to its empty weight, it is necessary to set a withdrawal force charged in the charge spring 45 or the like and a discharge force charged (accumulated) in the push spring 48 or the like while considering the empty weight of the sheet cassette 4 or sheet conveyance unit 50.

The oscillation unit 30 or 61 is provided in the sheet cassette frame 11 or the like that is a part of the apparatus main body 100A or 200A. Alternatively, the oscillation unit 30 or 61 can be provided in the sheet cassette 4 or sheet conveyance unit 50. Accordingly, the rack 18 or 54 and the oscillation unit switching groove 19 or 53 provided in the sheet cassette 4 or sheet conveyance unit 50 can be provided in the sheet cassette frame 11 or the like.

The push spring 48 is not always provided. If the push spring 48 is not provided, the charge amount of the charge spring 45 suffices to correspond to a force of withdrawing the sheet cassette 4 without need to withdraw the sheet cassette 4 against the push spring 58.

The charge arm 46 is not always provided. One end 45*a* of the charge spring 45 can be attached to the side surface of the input-side output gear 38*a* at a position of attaching the charge arm 46. In addition, the other end 45*b* of the charge spring 45 can be provided not on the side plate 33 but in the apparatus main body 100A.

While the reduction gear train 76 includes the odd-numbered gears 17, 37, and 38, the reduction gear train 76 can include even-numbered gears. In this alternative, since it is necessary to rotate the charge arm 46 in the direction of the arrow N to charge the charge spring 45 with energy, it is necessary to inverse a direction in which the charge spring 45 is spread. Further, the tension spring is used as the charge spring 45, a compression spring can be used as the charge spring 45. In this case, energy is charge in the compression spring by compressing the compression spring.

Moreover, out of the gears 17, 37, and 38 of the reduction gear train 76, at least the charge input gear 17 and the output-side charge output gear 38*b* can be replaced by friction rollers made of rubber or resin having high friction coefficient, the rack 18 can be replaced by a friction plate made of rubber or resin having high friction coefficient.

A tension spring or compression spring (not illustrated) provided between the lock member 39 and the side plate 33 (or 34) and urging the lock member 39 to rotate in the direction of the arrow YA can be used as the lock spring 40 in place of the torsion spring.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-072610, filed Mar. 24, 2009, which is hereby incorporated by reference herein in its entirety.

What is claimed is:

1. A slide unit moving device provided between an apparatus main body of an image formation apparatus and a slide unit provided on the apparatus main body to be withdrawable from the apparatus main body, for moving the slide unit with respect to the apparatus main body, comprising:

a rail on which the slide unit moves between an accommodation position and a withdrawal position;

a charge elastic member which is charged with energy to interlock with the slide unit moving from the accommodation position to the withdrawal position;

a lock unit which locks the charge elastic member into a state of being charged with the energy;

an interlocking release unit which releases interlocking of the charge elastic member with the slide unit with respect to the moving of the slide unit from the withdrawal position to the accommodating position; and an unlock unit which releases locking of the charge elastic member by the lock unit at a final stage of moving the slide unit from the withdrawal position to the accommodation position, wherein the slide unit is moved to the accommodation position by the energy charged in the charge elastic member by releasing locking by the lock unit at the final stage of moving the slide unit.

2. The slide unit moving device according to claim 1, further comprising an oscillation unit which transmits a charging force and a charged force between the slide unit and the charge elastic member, wherein the oscillation unit comprises:

an oscillation frame provided in the apparatus main body to be able to oscillate;

a rotating member train provided in the oscillation frame, and including a charge input rotating member and a charge output rotating member selectively interlockable with the slide unit according to oscillation of the oscillation frame, the charge elastic member being connected to the rotating member train;

the lock unit; and the interlocking release unit, the lock unit is provided in the oscillation frame to be engaged with the rotating member train, and includes a lock member preventing inverse rotation of the rotating member train in a state of interlocking the charge input rotating member with the slide unit moving from the accommodation position to the withdrawal position so as to charge the charge elastic member with the energy, the interlocking release unit is incorporated in the rotating member train, and is a ratchet mechanism allowing the inverse rotation of the charge input rotating member when the slide unit moves from the withdrawal position to the accommodation position and the charge input rotating member interlocking with the slide unit rotates inversely, and the unlock unit comprises:

an inclined portion provided in one of the apparatus main body and the oscillation unit;

an abutment portion provided in other one of the apparatus main body and the oscillation unit, and abutting on the inclined portion; and an abutted portion provided in the apparatus main body, abutted by the lock member when the oscillation unit oscillates by abutment of the abutment portion on the inclined portion in the final stage of moving the slide unit from the withdrawal position to the accommodation position.

3. The slide unit moving device according to claim 2, wherein the charge elastic member is a tension spring, one end of the tension spring is provided on one of the rotating members of the rotating member train, other end of the tension spring is provided on the oscillation frame, and the one end is located on an opposite side to the other end across a rotational center position of the rotating member on which the one end of the tension spring is provided when the rotating member on which the one end of the tension spring charges predetermined energy in the tension spring.

4. The slide unit moving device according to claim 2, comprising:

an oscillation elastic member provided between the apparatus main body and the oscillation unit, and oscillating the oscillation unit in a direction of interlocking the charge input rotating member with the slide unit; and a charge amount determination elastic member provided in the apparatus main body, and elastically deformed by rotation of the rotating member train, wherein the charge amount determination elastic member is elastically deformed by the rotating member train as the charge elastic member is charged with the energy, applying a force to the oscillation unit against the oscillation elastic member so that the inclined portion abuts on the abutment portion when the charge elastic member is charged with predetermined energy, and not applying the force to the oscillation unit when the charge elastic member is not charged with the predetermined energy.

5. The slide unit moving device according to claim 1, wherein the slide unit includes a rack along a moving direction of the slide unit, a charge output rotating member, including a plurality of gears, is overlapped and engaged with the rack, and a scissors-gear mechanism allowing mutual rotation of the plurality of gears by as much as a pitch of one gear tooth of each of the plurality of gears is provided among the plurality of gears.

6. The slide unit moving device according to claim 2, wherein the rotating member train includes a damper rotating member.

7. The slide unit moving device according to claim 2, wherein the rotating member train is a reduction gear train in which the charge output rotating member rotates at a lower velocity than a velocity of the charge input rotating member.

8. The slide unit moving device according to claim 1, comprising a moving elastic member provided between the apparatus main body and the slide unit, and moving the slide unit from the accommodation position to the withdrawal position, wherein the charge elastic member moves the slide unit from the withdrawal position to the accommodation position against the moving elastic member.

9. An image formation apparatus comprising:

the apparatus main body;

the slide unit accommodating a sheet, provided in the apparatus main body to be withdrawable from the apparatus main body, the sheet being loaded in the slide unit;

an image formation unit forming an image on the sheet fed from the slide unit; and the slide unit moving device according to claim 1, the slide unit moving device moving the slide unit with respect to the apparatus main body.

10. An image formation apparatus comprising:

the apparatus main body;

an image formation unit forming an image on a sheet;

the slide unit including the image formation unit, and provided in the apparatus main body to be withdrawable from the apparatus main body; and the slide unit moving device according to claim 1, the slide unit moving device moving the slide unit with respect to the apparatus main body.

* * * * *